US009039482B2

(12) United States Patent
Cohen et al.

(10) Patent No.: US 9,039,482 B2
(45) **Date of Patent: *May 26, 2015**

(54) INTERACTIVE TOY APPARATUS AND METHOD OF USING SAME

(75) Inventors: Moshe Cohen, Tel-Aviv (IL); Alan Sege, Santa-Montica, CA (US)

(73) Assignee: DIALWARE INC., Los Angeles, CA (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/812,877

(22) PCT Filed: Jul. 28, 2011

(86) PCT No.: PCT/IL2011/000611

§ 371 (c)(1),
(2), (4) Date: Jan. 29, 2013

(87) PCT Pub. No.: WO2012/014211

PCT Pub. Date: Feb. 2, 2012

(65) Prior Publication Data

US 2013/0130587 A1 May 23, 2013

Related U.S. Application Data

(60) Provisional application No. 61/368,675, filed on Jul. 29, 2010.

(51) Int. Cl.
*A63H 33/04* (2006.01)
*A63H 30/04* (2006.01)

(52) U.S. Cl.
CPC ..... *A63H 30/04* (2013.01); *A63H 2200/00* (2013.01)

(58) Field of Classification Search
CPC ..... A63H 33/00; A63H 2200/00; A63H 3/00; A63H 3/28; A63F 3/00; A63F 3/00643; A63F 9/02; A63F 9/24; A63F 13/00; A63F 13/06
USPC ..... 446/175, 297, 484; 434/169, 307 R, 434/308, 319–321, 322, 351, 393
See application file for complete search history.

(56) References Cited

U.S. PATENT DOCUMENTS 5,387,108 A 2/1995 Crowell
5,746,602 A * 5/1998 Kikinis ..... 434/169

(Continued)

FOREIGN PATENT DOCUMENTS

WO WO 00/01456 1/2000
WO WO 00/15316 3/2000
WO WO 2012/014211 2/2012

OTHER PUBLICATIONS

International Search Report and the Written Opinion Dated Jan. 9, 2012 From the US Patent and Trademark Office Re. Application No. PCT/IL2011/000611.

(Continued)

*Primary Examiner* — Kien Nguyen
(74) *Attorney, Agent, or Firm* — Roach Brown McCarthy & Gruber, P.C.; Kevin D. McCarthy

(57) ABSTRACT

A toy apparatus and method for interactive communication between a cellphone and a toy apparatus is disclosed. In an embodiment of the present invention, a method is provided, the method including: transmitting by the cellphone at least one signal; receiving by the toy apparatus the at least one signal; analyzing by the toy apparatus the at least one signal; determining by the toy apparatus at least one response to the at least one signal; and producing by the toy apparatus the at least one response.

19 Claims, 19 Drawing Sheets

(56) References Cited

U.S. PATENT DOCUMENTS

| | | | |
|---|---|---|---|
| 5,752,880 | A | 5/1998 | Gabai et al. |
| 6,773,344 | B1 | 8/2004 | Gabai et al. |
| 2003/0027636 | A1 | 2/2003 | Covannon et al. |
| 2003/0069069 | A1 | 4/2003 | Kinjo et al. |
| 2003/0115293 | A1 | 6/2003 | Fogg et al. |
| 2005/0222905 | A1 | 10/2005 | Wills |
| 2009/0264205 | A1 | 10/2009 | Atsmon et al. |
| 2010/0062819 | A1 | 3/2010 | Hannigan et al. |
| 2010/0226617 | A1 | 9/2010 | Piccionelli |
| 2010/0256976 | A1 | 10/2010 | Atsmon et al. |

OTHER PUBLICATIONS

International Preliminary Report on Patentability Dated Feb. 7, 2013 From the International Bureau of WIPO Re. Application No. PCT/IL2011/000611.

* cited by examiner

INTERACTIVE TOY APPARATUS AND METHOD OF USING SAME

RELATED APPLICATIONS

This application is a National Phase of PCT Patent Application No. PCT/IL2011/000611 having International filing date of Jul. 28, 2011, which claims the benefit of priority under 35 USC §119(e) of U.S. Provisional Patent Application No. 61/368,675 filed on Jul. 29, 2010. The contents of the above applications are all incorporated by reference as if fully set forth herein in their entirety.

BACKGROUND OF THE INVENTION

The present invention, in some embodiments thereof, relates to toys and, more particularly, to interactive toys.

Toys for children are intended not only for entertainment, but also to provide them with a learning experience. There are currently available various toys with which children may interact.

WO 00/01456 teaches a device which responds to incidental sound produced by a user. The sound may be, for example, ultrasound, infra-sound, or audible sound, and the toy response may be movement or production of a sound or a light display, or a response on a computer screen. The toy includes components which receive and analyze the acoustic signal and, depending on the particular signal received, the toy produces a corresponding response, such that interaction between the user and toy is simulated.

WO 00/15316 teaches toys which transmit acoustic, encoded, electromagnetic, RF, or light signals and respond thereto, such that they simulate interaction between toys. The toys include circuitry whereby they may communicate via computer, such that they need not be at the same location in order to transmit and receive signals therebetween.

Mobile phones are becoming increasingly popular and commonplace. It would be desirable to provide toys which can communicate with mobile phones, thereby taking advantage of the increasing availability and popularity of mobile phones.

SUMMARY OF THE INVENTION

The present invention, in some embodiments thereof, relates to an interactive toy apparatus and method whereby a toy apparatus may interact with a communication device. In particular, a signal may be transmitted from a communication device to the toy apparatus and the toy produces a response to the signal. In some embodiments, the toy apparatus receives a signal and responds by producing a signal transmitted from the toy apparatus to a cellphone. In some embodiments, a first toy apparatus transmits a signal to a second toy apparatus which responds thereto, wherein interaction is independently initiated by the first toy apparatus. In some embodiments, the toy apparatus is configured to acquire additional programming and/or alternative programming. In some embodiments, the toy response is modified by the location of the toy.

According to an aspect of some embodiments of the present invention there is provided a method for interactive communication between a cellphone and a toy apparatus, said method comprising: transmitting by the cellphone at least one signal;

receiving by the toy apparatus the at least one signal; analyzing by the toy apparatus the at least one signal; determining by the toy apparatus at least one response to the at least one signal; and producing by the toy apparatus the at least one response.

According to some embodiments of the invention said toy is programmed by said at least one signal.

According to some embodiments of the invention at least one of the at least one signal is an acoustic signal.

According to some embodiments of the invention the at least one response includes generating a signal, transmitting the generated signal to a cellphone, and forwarding the signal by the cellphone.

According to some embodiments of the invention the at least one signal includes a coupon code, the at least one response including recording the coupon code; wherein said method further comprises accessing by one of an authorized user and a coupon accessing device the coupon code; and deleting by one of the authorized user and the coupon accessing device the coupon code from the toy apparatus.

According to some embodiments of the invention said interactive communication includes acquiring Internet site data, the at least one signal including Internet site data; wherein said method further comprises, before said transmitting at least one signal: coupling the toy apparatus to an electronic device; and accessing the Internet via the electronic device; wherein said producing includes transmitting a signal by the toy apparatus to a user responsive to the data.

According to some embodiments of the invention the method is further performed for acquiring additional or alternative programming by the toy apparatus, wherein said at least one signal is an acoustic signal, and wherein the response is external if the signal indicates an activity and the response is programming of the toy, if the signal indicates programming According to an aspect of some embodiments of the present invention there is provided a method for interactive communication with a toy apparatus, the method comprising: receiving by the toy apparatus at least one first signal; analyzing by the toy apparatus the at least one first signal; determining by the toy apparatus at least one response to the at least one first signal; and producing by the toy apparatus at least one response.

According to some embodiments of the invention the interactive communication includes coupon redemption, the at least one first signal includes a coupon code, and said producing at least one response includes recording by the toy apparatus the coupon code; said method further comprising: assessing by one of an authorized user and a coupon accessing device the coupon code; and deleting by one of the authorized user and the coupon accessing device the coupon code from the toy apparatus.

According to some embodiments of the invention said at least first signal is transmitted by an electronic greeting card.

According to some embodiments of the invention the at least first signal is received from one of a user and a communication device.

According to some embodiments of the invention the at least first signal is received from a communication device and the communication device is one of a cellphone, an Internet server, a computer, a laptop, a PDA, a tablet PC, a landline phone, an electronic greeting card, a controller, a toy apparatus and a music player.

According to some embodiments of the invention the at least one first signal is at least one of an acoustic signal, a tactile signal, a Bluetooth signal, a Wi-Fi signal, a Z-wave signal, a Zigbee signal, an Infrared signal, a GPRS signal, a 3G signal, an SMS, an MMS, an email message, an NFC signal and an RFID signal.

According to some embodiments of the invention the at least one first signal contains data.

According to some embodiments of the invention the data is based on the location of the toy apparatus.

According to some embodiments of the invention the data is one of a coupon code, a ringtone, music data and Internet data.

According to some embodiments of the invention the data is a coupon code and the coupon code may be redeemed through a plurality of redemption means.

According to some embodiments of the invention the data is a coupon code and the coupon code is one of a one-time use coupon code and a multiple-time use coupon code.

According to some embodiments of the invention the communication device is an electronic greeting card and the electronic greeting card is one of an audio greeting card, a video greeting card and a multimedia greeting card.

According to some embodiments of the invention the data is Internet data and the Internet data is Website data.

According to some embodiments of the invention the method further comprises coupling the toy apparatus to an Internet enabled device to access the Internet data.

According to some embodiments of the invention the at least one response comprises at least one second signal.

According to some embodiments of the invention the method further comprises transmitting the at least one second signal to at least one of at least one toy apparatus and at least one communication device.

According to some embodiments of the invention the at least one response is at least one of an audible response, a transmission of information, storage of information, a mechanical response, an activity, and a behavior.

According to some embodiments of the invention the activity is at least one of transmitting a message, playing a ringtone, actuating an electronic greeting card and playing music.

According to some embodiments of the invention the behavior is at least one of a smile, a movement and a frown.

According to some embodiments of the invention the at least one response is re-programming of the toy apparatus.

According to some embodiments of the invention the at least one first signal is pre-programmed into the toy apparatus to be received at a predetermined time.

According to an aspect of some embodiments of the present invention there is provided an interactive toy apparatus comprising: a reception module configured for receiving at least one first signal; an analyzer module configured for analyzing the at least one first signal; a controller module configured for determining at least one response to the at least one first signal; and a response module configured for producing the at least one response.

According to an aspect of some embodiments of the present invention there is provided an interactive toy kit comprising the interactive toy apparatus of claim 31 and a cellphone, said reception module configured for receiving at least one first signal from said cellphone; wherein the at least one response is determined by said controller module, the at least one response including a signal transmitted from said toy apparatus to said cellphone.

According to some embodiments of the invention said apparatus comprises a pre-program module configured for pre-programming the at least first signal into the toy apparatus to be received at a predetermined time.

According to some embodiments of the invention the apparatus further comprises a coupling module configured for coupling to an Internet enabled device to access Internet data.

According to some embodiments of the invention said response module is configured for generating at least one second signal.

According to an aspect of some embodiments of the present invention there is provided a method for interactive play between at least two users, the interactive play being by at least one toy apparatus, each user of the at least two users being associated to the at least one toy apparatus, said method comprising: receiving at least two signals by the at least one toy apparatus, each of the at least two signals being corresponding to each of the at least two users; analyzing the at least two signals; generating one or more response corresponding to the at least two signals; and determining the result of the interactive play.

According to some embodiments of the invention each user of the at least two users is associated with a separate toy of the at least one toy.

According to some embodiments of the invention receiving at least two signals comprises receiving each of the at least two signals from a plurality of communication devices.

According to some embodiments of the invention at least one user of the at least two users is a computing device.

According to some embodiments of the invention the computing device is a part of the at least one toy apparatus.

According to an aspect of some embodiments of the present invention there is provided an interactive toy apparatus for hosting an interactive play between at least two users, each user of the at least two users being associated to the at least one toy apparatus, the interactive toy apparatus comprising: a reception module, the reception module receiving at least two signals by the at least one toy apparatus, each of the at least two signals being corresponding to each of the at least two users; an analyzer module, the analyzer module analyzing the at least two signals; a response module, the response module generating one or more response corresponding to the at least two signals; and a result module, the result module determining the result of the interactive play.

According to an aspect of some embodiments of the present invention there is provided a method for interactive communication between a toy apparatus and a cellphone, said method comprising: generating an signal by a toy; transmitting the generated signal to a cellphone; and forwarding said signal by said cellphone.

According to an aspect of some embodiments of the present invention there is provided a method for coupon redemption with an interactive toy apparatus, said method comprising: transmitting a coupon code to the toy apparatus; receiving by the toy apparatus the coupon code; recording by the toy apparatus the coupon code; accessing by one of an authorized user and a coupon accessing device the coupon code; and deleting by one of the authorized user and the coupon accessing device the coupon code from the toy apparatus.

According to an aspect of some embodiments of the present invention there is provided a method for acquiring Internet site data with an interactive toy apparatus, said method comprising: coupling the toy apparatus to an electronic device; accessing the Internet via the electronic device; transmitting by the electronic device Internet site data; receiving by the toy apparatus the Internet site data; and transmitting a signal by the toy apparatus to a user responsive to said data.

According to an aspect of some embodiments of the present invention there is provided a method for interactive communication between a toy apparatus and another entity, said method comprising said toy apparatus independently initiating interaction between the toy apparatus and the other entity.

According to some embodiments of the invention the another entity comprises a second toy apparatus.

According to an aspect of some embodiments of the present invention there is provided a method for interactive communication between a user and a toy apparatus, said method comprising transmitting a signal by the user to the toy apparatus via a human communication channel.

According to some embodiments of the invention said channel comprises one of a telephone, an email message, an SMS, or a ringtone.

According to an aspect of some embodiments of the present invention there is provided a method for interactive communication between an electronic greeting card and a toy apparatus, said method comprising: transmitting by the electronic greeting card at least one signal; receiving by the toy apparatus the at least one signal; analyzing by the toy apparatus the at least one signal; determining by the toy apparatus at least one response to the at least one signal; and producing by the toy apparatus the at least one response.

According to an aspect of some embodiments of the present invention there is provided a method for interactive play between at least two users each associated with at least a first toy apparatus, said method comprising: performing a set of play interactions between each user and the at least first toy apparatus, a first set of play interactions including transmitting by a first user via a cellphone to the at least first toy apparatus at least one signal and at least a second set of play interactions including transmitting by at least a second user to the at least first toy apparatus at least one signal; and for each user producing by the at least first toy apparatus at least one response, the at least one response includes incrementing a corresponding point counter associated with a corresponding user if the at least one signal is one of a recognized set of signals; determining by one of the at least first toy apparatus a winner, ending play, and producing a winning signal.

According to some embodiments of the invention, said determining comprising one of: (a) determining by one of the at least first toy apparatus whether one of the point counters has reached a predetermined threshold; and if one of the point counters has reached the predetermined threshold, ending play and producing by the one of the at least first toy apparatus a winning signal; and (b) determining elapsed time from the start of play; ending play when the elapsed time reaches a predetermined threshold; determining by the at least one toy apparatus which of the point counters has recorded more points; producing by one of the at least one toy apparatuses a winning signal associated with one of the users if a corresponding point counter has recorded more points.

According to an aspect of some embodiments of the present invention there is provided a method for acquiring additional or alternative programming by an interactive toy apparatus programmed for interactive communication comprising: receiving by the toy apparatus an acoustic signal; analyzing by the toy apparatus the first signal; determining by the toy apparatus a response to the first signal; producing said response by said toy, the response being external if the signal indicates an activity and the response being programming of said toy, if the signal indicates programming According to an aspect of some embodiments of the present invention there is provided an interactive toy kit comprising: a cellphone; and a toy apparatus comprising: a reception component configured for receiving at least one signal from the cellphone;

a signal analyzer configured to analyze the at least one signal; a controller; and a responsive component, configured to produce at least one response to the at least one signal, said at least one response determined by said controller, said at least one response including a signal transmitted from said toy apparatus to said cellphone.

According to an aspect of some embodiments of the present invention there is provided an interactive toy apparatus configured to perform different actions based on location based data.

According to some embodiments of the invention said toy is configured to receive at least one location indication, said toy apparatus comprising a device configured to transmit the location of the toy apparatus to a remote location.

According to some embodiments of the invention said device selected from a GPS chip, a GPRS chip, an EDGE chip, a CDMA chip, and a GSM chip.

According to some embodiments of the invention the device is a GPS chip configured to transmit a location of said toy apparatus via a GPS satellite to a GPS location server.

According to an aspect of some embodiments of the present invention there is provided an interactive toy system wherein a location based entity is selected from an Internet, an NFC reader, a cellular phone, and said toy apparatus; wherein said toy apparatus configured to receive data via the entity, based on the location of the entity.

According to some embodiments of the invention said location based entity is said toy apparatus and said toy apparatus is configured to be connected to the Internet.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Figure 1:
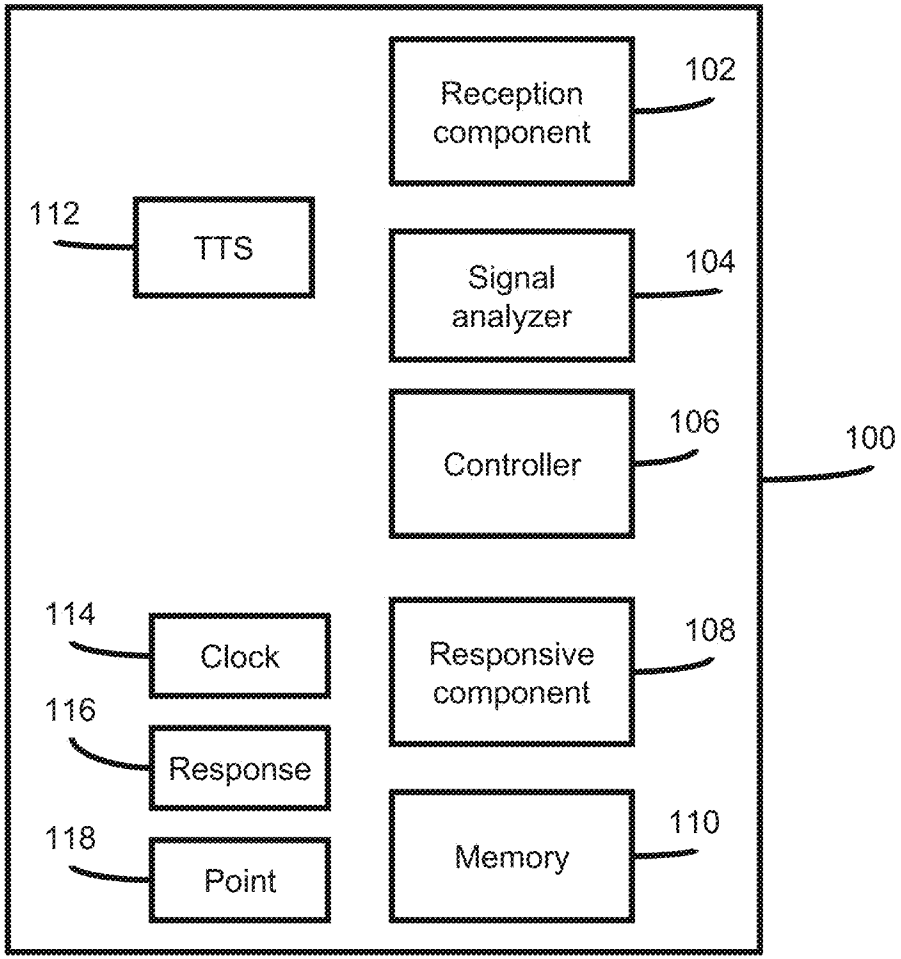
FIG. 1 is a schematic representation of the components of a toy apparatus, in accordance with an embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE DRAWINGS

The present invention, in some embodiments thereof, relates to toys and, more particularly, but not exclusively, to interactive toys which provide at least one response to communication directed at the toy. In an exemplary embodiment of the invention, the communication may be a regular audio communication. Optionally, the communication includes a coded section which may only be detected and/or understood by the toy. In an exemplary embodiment of the invention, the toy includes at least some ability to recognize words of speech, for example, user dependent or user independent recognition.

An aspect of some embodiments of the invention relates to communication with toys using cellphones, optionally via an audio channel of the toy and of the cellphone. In an exemplary embodiment of the invention, a cellphone receives a message, for example, an MMS (Multimedia Messaging Service), an SMS (Short Message Service) or a ringtone, and when the message is played, a toy may be programmed or reacts. In some embodiments, a cellphone communicates with a toy using a wireless link built into the cellphone, for example, Wi-Fi or Bluetooth.

An aspect of some embodiments of the invention relates to direct communication (e.g., by a human or by a machine) with a toy, optionally using human communication methods. In one embodiment, a telephone line may be used to communicate with a toy. Optionally, the caller (e.g., a recorded voice) asks to talk to the toy. In another example, e-mails may be sent to the toy, to be read out or played [e.g., a .WAV (Waveform Audio Format) file] by a human using a readout device such as a cellphone or a computer. In another embodiment, the toy itself initiates a communication session, for example, by playing a message asking a human to place a phone call or to send a message or to take the toy to a location at which the toy may interact with another device.

An aspect of some embodiments of the invention relates to communication with a toy using a card, optionally an electronic greeting card. In an exemplary embodiment of the invention, the electronic greeting card (or other sound playing card, optionally formed of paper or thin board) plays an audio signal when opened or otherwise activated and the toy recognizes part of the signal and acts thereon. Optionally, the signal may be used to program the toy. Optionally or alternatively, the signal may be used to trigger pre-programmed actions in the toy.

In an exemplary embodiment of the invention, such cards may be sold for entertainment or greeting. Optionally or alternatively, the cards may be sold for loading abilities and/or for allowing functions in the toy.

An aspect of some embodiments of the invention relates to using coupons with toys. In an exemplary embodiment of the invention, a toy may play a coupon code at a sales point. Optionally or alternatively, a coupon code may be sent to a toy, for example, by another toy, by WAV file or by telephone. In an exemplary embodiment of the invention, coupons may be exchanged in games by winning or losing. In an exemplary embodiment of the invention, a toy may generate coupons according to programming provided therefor.

In an exemplary embodiment of the invention, a coupon ID includes a toy ID, which is optionally unique for each toy and/or toy type.

An aspect of some embodiments of the invention relates to a toy acting as an intermediate for a parent or remote server. In one example, a toy may be used to communicate with parents (e.g., toy conveys messages and questions from child to parent or other adult and back). In another example, the toy acts as an intermediary between a toy seller (or computer) or other child and the child.

An aspect of some embodiments of the invention relates to a toy acting as a companion of a child. In an exemplary embodiment of the invention, the toy may be carried around to various locations, for example, a bedroom, a TV area, a movie theater, a mall and/or a toy store. The toy optionally receives signals at such locations and/or generates output signals or responses appropriate to the context of the location and/or ongoing activity. In one example, the toy relates to TV or DVD (or other video media) content. In one example, the toy or a set of toys reenact behavior shown in a TV program. In another example, the toy provides the child with a summary of an ongoing or upcoming TV show.

An aspect of some embodiments of the invention relates to a toy programming other toys, based on information it received. In one example a toy generates and/or transmits instructions to other toys on how to act out a TV scene. Such programming may be transmitted, for example, by acoustic signals or RF or IR signals.

In an exemplary embodiment of the invention, the toy may be a mobile play figure, for example, between 2 and 10 inches in maximal extent and weighing less than 1 kg or 500 grams. Optionally, the toy represents an action figure or doll. In an exemplary embodiment of the invention, the toy may be dressable or dressed. Optionally or alternatively, the toy may be furry. Optionally or alternatively, the toy includes one or more movable limbs or wheels. Optionally or alternatively, the toy is a reduced scale and reduced functionality representation of a device. In some embodiments, the toy includes cellphone circuitry. In a particular example, the toy is a body or covering into which a cellular telephone is placed. In some embodiments, the toy is replaced by a cellular telephone or a computer.

An aspect of some embodiments of the invention relates to interactive play between at least two users, the interactive play being by at least one toy apparatus, each of the at least two users being associated therewith.

An aspect of some embodiments of the invention relates to a method for acquiring Internet site data with an interactive toy apparatus.

An aspect of some embodiments of the invention relates to a method for acquiring additional or alternative programming by an interactive toy apparatus programmed for interactive communication.

An aspect of some embodiments of the invention relates to an interactive toy apparatus whose actions and/or responses are modulated by location based information. In one example, the toy includes a location based system, such as GPS system or a cellular circuit. In another example, location is provided by a nearby cellular telephone or computer. In another example, a human is asked for the location. In another example, a beacon, such as an RF transmitter at a toy store, provides the location. In another example, a service provider, such as an internet server changes its transmission to a toy, based on the toy's location. In an exemplary embodiment of the invention, the toy generates an action which is triggered by arriving at the location. In another example, the toy chooses one of several possible responses, based on its location. In another example, the toy generates a request to a user to move it to a desired location, where, another action will commence. While in some embodiments the action of the toy may include displaying a location, for example, using a visual display or acoustic display, in an exemplary embodiment of the invention, the action modified and/or triggered by the location includes a physical action such as movement and/or data transmission. Optionally or alternatively, while the action may be a display, the display is optionally of data selected or calculated according to the location and not merely a location indication.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Exemplary Toy Apparatus and its Basic Components

Referring now to the drawings, FIG. 1 is a schematic representation of the components of a toy apparatus, in accordance with an embodiment of the present invention. There is shown a toy apparatus 100 including a reception component 102 (e.g., a microphone), a signal analyzer 104 (e.g., hardware and/or software, optionally including a speech recognition module), a controller 106 (optionally combined with the signal analyzer), and a responsive component 108 (e.g., a motor and/or a speaker). Additionally, toy apparatus 100 optionally includes a memory 110, for example, non-volatile memory. Optionally, toy apparatus 100 includes a wireless RF transponder, for example, Wi-Fi or Bluetooth, for example, instead of or in addition to audio components.

Toy apparatus 100 is optionally configured as a toy such as, for example, a puppy, a duck, or a soldier. The particular configuration of a toy apparatus is optionally chosen such that it will be attractive to a child and appropriate for his age. This may be especially important, as will be discussed below, as the toy apparatus in some embodiments may be played with by a child. Also as discussed below, in additional embodiments, the toy apparatus may be employed as a behavioral aid and/or as an educational tool, and it is important that a child who is utilizing such a toy apparatus will be encouraged to cooperate, as a toy configuration is intended to be attractive to him and to give him the feeling that he is having fun while learning.

Reception component 102 may be one of various components known in the art which are able to receive signals having particular parameters or of a particular type transmitted by, for example, another toy apparatus, a human voice, a landline phone, a mobile phone, an audio speaker, a PC, a television, a radio, a sound system, a DVD, an electronic greeting card, and the Internet. The signal may be provided in an MMS (multimedia messaging service) on a mobile phone or a PC, and may be provided in response to an SMS (short message service) sent by a user. Reception component 102 also may include a voice recognition component, a speech recognition component, a sound recognition component, or other component for reception of signals such that, for example, reception component 102 may include a microphone for receiving a voice signal, a ringtone, or an email transmitted by a PC or, alternatively, may include a reader for reading text or a signal encoding a picture. Additionally, toy apparatus 100 may receive a signal including a coupon, as will be discussed below. Additionally in accordance with embodiments of the invention, the user of toy apparatus 100 may receive a phone call including instructions to pass the phone call on to the toy apparatus. This may be done by turning on the phone's speaker or by positioning the toy apparatus close enough to the phone such that an acoustic signal may be transmitted to the toy apparatus. In an exemplary embodiment of the invention, the toy speaker and microphone may be located in a geometry compatible with speaker/microphone distances of telephones. Alternatively, a signal may be transmitted from a phone to a toy apparatus having Bluetooth capability or other near-distance wireless transmission standard. A toy apparatus may produce a response including a signal transmitted by the cellphone or an audible response asking for a phone call to be made, wherein it may transmit a signal via a cellphone.

Additionally, it will be appreciated by persons skilled in the art that a signal received by the toy apparatus 100 may be transmitted by any device having a speaker. Similarly, a signal transmitted by the toy apparatus may be received by any device having a microphone.

Figure 2:
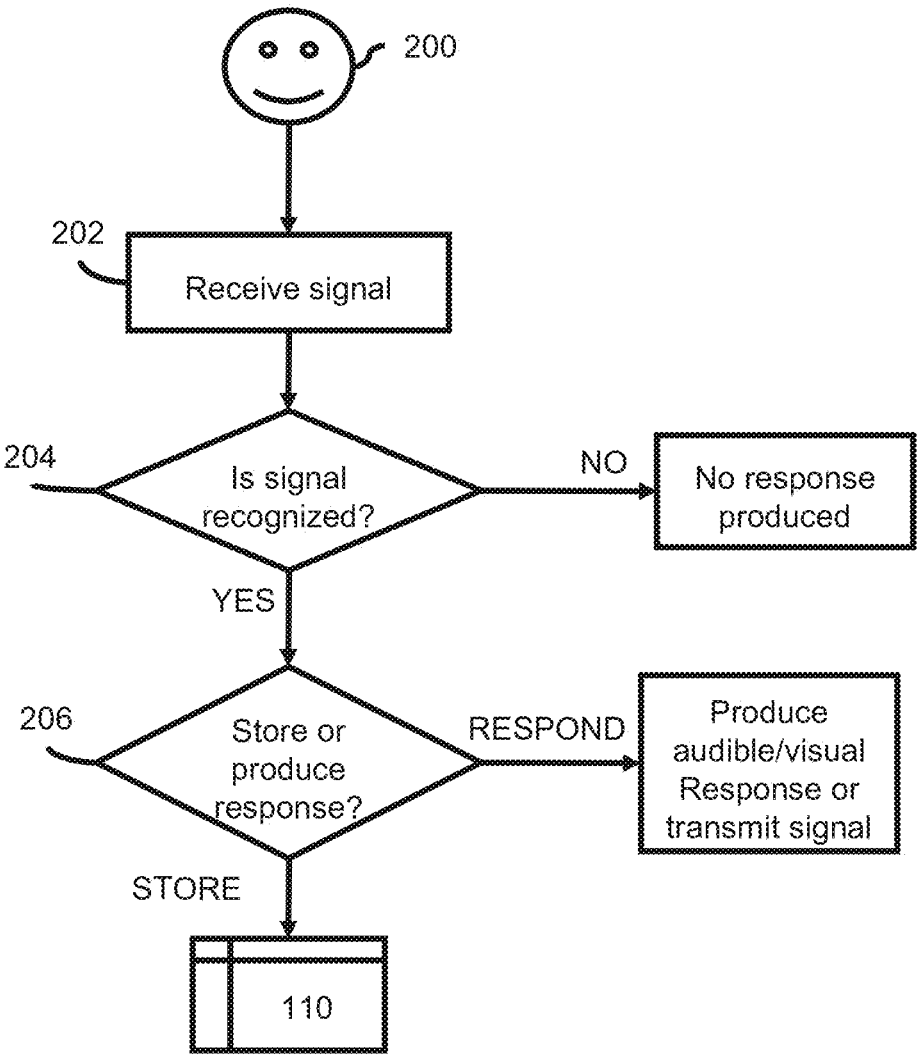
FIG. 2 is a flowchart illustrating transmission of a signal to a toy apparatus and a corresponding response, in accordance with an embodiment of the present invention.

FIG. 2 is a flowchart illustrating transmission of a signal to a toy apparatus and a corresponding response, in accordance with an embodiment of the present invention. With reference to FIG. 1, a user 200 may send a signal (for example, an audible signal) which may be received at 202. The signal may be sent to the signal analyzer 104 at which the signal may be analyzed, shown at 204, to determine whether it is one a recognized set of signals, as will be discussed below. The analysis may be done by one of a variety of methods, including using a look-up table, and choosing from a list of options. Based on this analysis, the toy apparatus may respond to the signal. If the signal is not recognized as being one of a preselected set of signals, there will be no response. If the signal is recognized as being one of a preselected set of signals, then at 206 a corresponding response will be determined, for example, data (e.g., usage or programming) may be stored in the memory 110 of the toy apparatus. A corresponding response may be an audio or visual response (e.g., movement of limb/component or toy, data on a display and/or lights), observable by a user, or a signal transmitted by the toy apparatus 100, for example, to a cellphone, as discussed further below.

For example, if an audible signal is transmitted by the user 200, the signal analyzer 104 optionally determines whether the signal is selected from a preselected group of spoken words or phrases. The controller 106 may determine how the responsive component 108 will cause the toy apparatus 100 to respond by transmission of a response selected from a preselected set of responses, including storage of data in the memory 110, an audible or visual response, or a transmitted signal, as will be discussed in detail below. In an exemplary embodiment of the invention, the toy apparatus 100 may be programmed to recognize phrases by one or more certain speakers. Alternatively, speaker independent recognition may be used. Optionally, the signal includes codes, for example, DTMF (dual tone multifrequency) signaling or other acoustic modulations, audible or not (e.g., ultrasonic). Optionally, the signal may be encoded or regular speech, or may be an overlay of code on regular speech. Optionally, the signal may be transmitted via a storage and playback device. Optionally, the signal may be transmitted from a cellphone, for example, in realtime.

Optionally, there may be provided a realtime audio streaming device which receives a sound signal from remote location and streams it to the toy apparatus. Optionally, the response of the toy apparatus may be, for example, an audio or visual response, and may be processed by a cellphone or streamed to a remote location.

If desired, software may be installed on the telephone, for ex an APP (application software), wherein the software provides a connection to a remote location. Optionally, the software may perform processing or may do local generation of commands to the toy apparatus. In addition, there may be provided a user interface through which the user may program the toy apparatus.

Optionally, instead of a cellphone, the above-discussed actions may be performed by a tablet computer.

As the toy apparatus 100 may be a recipient of communication, the communication possibly being encoded, the information provided to the toy apparatus 100 in the communication may be known only to the toy apparatus 100, until it may be transmitted further, for example, to a child or to a parent.

Optionally, the toy apparatus 100 includes a TTS (text to speech) system 112 (FIG. 1) such that, for example, upon reception of a text signal by the reception component 102, the responsive component 108 may cause the toy apparatus 100 to produce sounds simulating speech.

Optionally, the toy apparatus 100 has an operational mode, in which it may be able to receive signals and respond thereto, as discussed above, and a stand-by mode, in which it may receive signals but does not respond thereto. Optionally, a user may switch between these modes by transmitting a password to the toy apparatus 100. In an embodiment, the password may be a voice-transmitted password, which may be specific to the user's toy apparatus, and may be accessible only to the user. The password thereby may constitute an actuating signal which may be received by the apparatus and analyzed thereby, whereafter the apparatus may respond by switching to operational mode. If desired, the same password or a different password may be used to switch the apparatus back to stand-by mode.

Optionally, the toy apparatus 100 may be provided with a clock or timer 114, a response counter 116 to record the number of responses within a preselected time period, and/or a point counter 118, for example as will be discussed below. In an exemplary embodiment of the invention, if the number of responses recorded in a preselected time period is more than a preselected threshold, the toy responds, for example, by saying "good job!" or by flashing lights or ringing bells, or a combination thereof.

Optionally, toy apparatus 100 includes a location circuit which receives a location indication or which generates such an indication. Optionally, the toy acts or reacts differently based on its location. Optionally or alternatively, a remote server, such as over the internet, or a local server, such as a program on a nearby PC or cellphone, which communicate with the toy, may act differently and/or send different data or commands based on the toy's position. Optionally or alternatively, country personalization or other location based personalization may be provided, for example, setting language and/or units.

Various modes of using a toy apparatus as described above will be described. A single implementation may include features from various modes and/or allow a plurality of modes to be supported in a single toy.

Interaction with One Toy

As discussed above, the toy apparatus 100 may receive signals with particular parameters or of a particular type, and may respond by transmission of a response selected from a preselected set of responses. The response may be selected from, for example, an audible response, a transmission of information, storage of information, a mechanical response, or a combination thereof. The responses may be immediate or delayed, for example delayed by a specific amount of time or delayed to a particular time of day.

In accordance with an embodiment of the present invention, a toy apparatus 100 resembling an animated character such as a person or an animal may be provided. The signal analyzer 104 may determine whether a signal received by the toy apparatus 100 is one of a first group or one of a second group of preselected signals and, depending thereon, the toy apparatus 100 may respond with a corresponding response selected from a first group or from a second group of responses. For example, if the signal received is a "positive signal" such as, for example, a spoken word selected from "please" and "thank you" or a ringtone indicating a phone call from a friend, the toy apparatus 100 may produce a response selected from a first group of "positive responses" including, for example, happiness indicating behaviors such as smiling, laughing, and tail wagging and excitement indicating behaviors such as running, jumping, and laughing. Alternatively or additionally, if the signal received is a "negative signal" such as, for example, a ringtone which does not indicate a phone call from a friend, the toy apparatus 100 may produce a "negative response" selected from a second group of responses including, for example, disappointment indicating behaviors such as frowning; confusion indicating behaviors such as staggering or lying down; and sadness indicating behaviors such as moaning and crying. These responses may be important if the toy apparatus 100 is employed as an educational tool in the treatment of certain conditions such as, for example, autism, as will be discussed below. Optionally or alternatively, such responses (e.g., to incoming calls) may be useful to enhance the connection and physical proximity between the toy apparatus 100 and the child. Optionally or alternatively, an "emotional response" may be presented, for example, one indicating happiness, surprise, fear or other emotions.

According to an embodiment of the invention, the toy apparatus 100 may receive a signal from a television program and, depending on at what point in the program the television set was turned on, the toy apparatus 100 may relate the context of the program to the child, for example, in with an audible signal. This may be especially useful if the television was turned on after a program has begun. Optionally or alternatively, the toy apparatus 100 may summarize previous episodes of the television program. Optionally or alternatively, the toy apparatus 100 may answer questions (e.g., posed using an IVR system provided by the toy apparatus 100 or by responding to recognized keywords) the child may ask regarding particular characters in a television program or may provide commentary about a television program to a child. Optionally, the toy apparatus 100 may download or may activate signals to recognize based on the context, for example, identity of the TV show. Optionally, a server may be provided for the toy apparatus 100 to download from recognition signals and/or behaviors.

According to another embodiment, a user may purchase the toy apparatus 100 at a movie theater, the toy apparatus 100 programmed to interact with the user and/or provide the user with a commentary regarding the movie.

Optionally, the toy apparatus 100 records the content of a television (or other media) program and repeats the content so as to reinforce a message or so as to repeat a portion of the program for the child's enjoyment. Optionally, the toy apparatus 100 may be programmed to respond to a specific signal transmitted by the television, such that the toy apparatus 100 may produce a specific response to the specific signal. Alternatively, the toy apparatus 100 may transmit a signal including the content to another toy apparatus, for play with more than one toy apparatus, as will be discussed below. In an exemplary embodiment of the invention, the toy apparatus 100 may be programmed (e.g., by audio signals from the TV or by other means) to act out behavior or scenes as shown on the show or which follow from what was shown, for example, as a natural consequence or as a possible future of the show.

Optionally, an advertisement broadcast during a television program includes a signal to a child to purchase additional toy apparatuses or accessories therefor, as discussed below. Such a signal may be stored by the toy apparatus 100 and may be used to later provide an advertisement or activity to the child.

Optionally, a television set or DVD may include a program rating chip. Optionally, a rating or other information may be transmitted to a toy which may act as a content guardian. For example, the toy apparatus 100 may respond by transmitting an audible warning or sending a message to a parent, optionally by an SMS to his cellphone, in the event that a child has turned on a program which is inappropriate for him. Alternatively, the toy apparatus 100 may send a signal to the television set to turn itself off. Optionally, the television set may be turned on (or may only stay on) if the toy apparatus 100 is located within a certain distance (for example, by exchanging signals with the toy, optionally periodically), thereby preventing a child from watching inappropriate programming. Optionally, the toy apparatus 100 may include a special communication channel, for example, wireless RF, via which it may communicate with a television set, which is optionally modified for such communication.

According to another embodiment, the toy apparatus 100 may be part of an educational program, for example, utilized to teach a child to perform steps of a method. For example, before the child performs each step of a method, the toy apparatus 100 may transmit to a child, for example, by an audible signal, detailed instructions for completing the step and the child may then announce when he has completed the step and may announce what the intermediate result is. As there are a limited number of possibilities for the step to be done correctly, incorrectly, or not at all, the toy apparatus 100 may recognize whether the step has been done correctly and, if so, may provide the child with encouragement and may transmit the next step. If the step has been done incorrectly, the toy apparatus 100 may recognize this fact and provide instructions as to how to correct the step. If the step has not been done at all, the toy apparatus 100 may provide the child with encouragement for performing the step. Optionally, when connected to an appropriate Internet Website, as discussed below, the toy apparatus 100 may control the Website to show, for example, results if each step is performed correctly.

By way of example, the toy apparatus 100 may aid a child in performing specific tasks such as making a sandwich, making a phone call, or any other daily activity. The toy apparatus 100 may provide a child with audible instructions in the form of steps to be followed.

Optionally, the toy apparatus 100 includes a camera which may be used to image a final or intermediate result of the activity.

Optionally, the toy apparatus 100 is programmed according to the personality or the expected behavior of a particular child, for example, a child having ADHD (attention deficit/hyperactivity disorder), ADD (attention deficit disorder), autism, dyslexia, or any other known disorder or condition. For example, a child with autism typically may not maintain eye contact with a person speaking with him. The toy apparatus 100 in accordance with the invention may include an angle-dependent receiver that may be sensitive to the direction of sound it receives, such that a child speaking to the toy must be facing the toy in order for the toy to receive a voice signal from the child and to respond. Such a toy may be part of a training system to be developed, for example, with the child's parents and psychologist, such that the toy apparatus may be employed as an educational tool in the treatment of autism. Other beneficial uses of toy apparatus in accordance with the invention may be developed by health professionals and by persons skilled in the art.

User Playing Game or Doing Task by Himself with Toy

The toy apparatus 100 having the clock 114, the response counter 116, and/or the point counter 118 as discussed above may be utilized by a user for playing a game. For example, the user may play a game (or homework) having a number of tasks to do during a predetermined time period. When he finishes performing a task, he may say "Done," whereby his voice signal may be transmitted to the toy apparatus 100 which receives this signal and responds, for example, by saying "Good. What's next?" and adding a point to the point counter 118. If the number of points recorded in a preselected time period is more than a preselected number, for example 15 points, the toy may respond, for example, by saying "You're doing great," by flashing lights, by ringing bells, or by a combination thereof.

Optionally, the toy apparatus 100 may ask the child a question and a point may be awarded according to the received answer. Optionally, the answer includes manipulation of the toy apparatus 100 or an element thereof. For example, a child may require encouragement when clearing up his bedroom, as this may seem like an enormous assignment for him to accomplish on his own. This assignment may be broken down into simpler tasks such as, for example, putting dirty laundry in a laundry hamper, putting away toys, and straightening up shelves. A suggestion of each of these simple tasks may be audibly transmitted to the child by the toy apparatus 100, such that the child may see the assignment as a combination of relatively simple tasks which are easy to accomplish. As the child accomplishes each task, he may say "Done," and the toy apparatus 100 may audibly transmit encouraging comments such as "Good work." In this manner, the child may find the entire assignment easier to do, as he may receive encouragement at various times throughout the entire assignment.

Adult Sending Signals to a Toy

Figure 3:
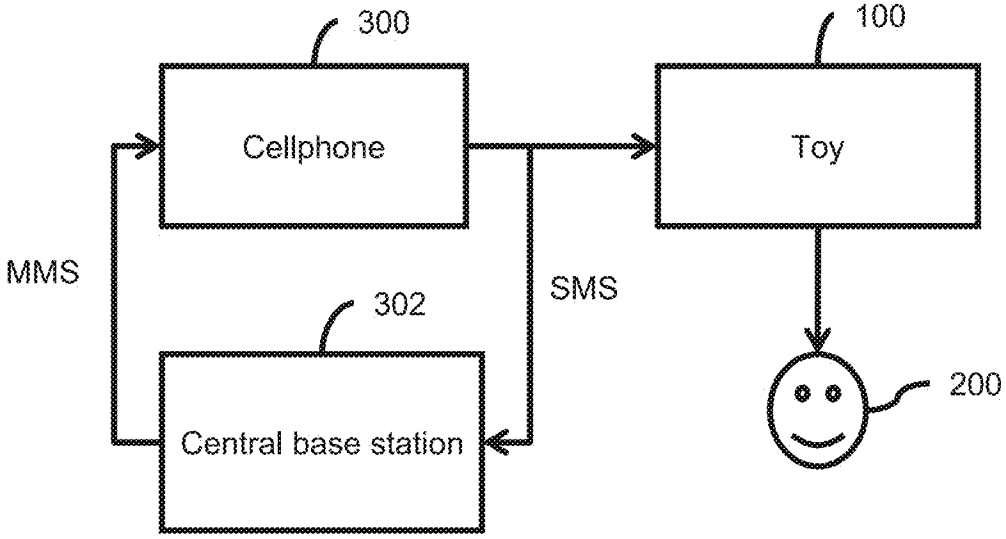
FIG. 3 is a flowchart of a method for controlling a toy apparatus, in accordance with an embodiment of the present invention.

FIG. 3 schematically illustrates a method by which a toy apparatus, in accordance with an embodiment of the present invention, may be controlled by an adult when he wishes his child to follow certain instructions. As shown in the drawing, an adult such as a parent may send one of a predetermined set of SMS's from a cellphone 300 to a central base station 302, after which the central base station 302 may transmit back to the cellphone 300 a corresponding MMS including a signal to be transmitted to his child's toy apparatus. Alternatively, a parent may send a signal from the cellphone 300 to the toy apparatus 100, the signal being, for example, added to or encoded in an SMS. Alternatively, the cellphone 300 may have a program that sends coded SMS's. Alternatively, a signal may be sent directly from the cellphone 300 to the toy apparatus 100, the signal being included in a ringtone, in a coded SMS, or in an MMS. Optionally, the signal is sent to a child's cellphone which may then be used to communicate with the toy apparatus 100. Alternatively, the toy apparatus 100 may include a cellphone or other wireless receiver. In another embodiment, the communication may be by e-mail, which e-mail may be played by the child to the toy apparatus 100. Optionally, the cellphone 300 may initiate a check if a communication was received, for example, based on inner state-based logic and/or timing.

In response to the signal received, the toy apparatus 100 may, for example, produce an acoustic response transmitted to the user 200, the acoustic response simulating spoken instructions for the user 200 (child). In this manner, for example, when a parent wishes his child to get ready for bed, he may send an SMS requesting bedtime assistance and the signal received by the toy apparatus 100 via the MMS may cause the toy apparatus 100 to encourage the child to get ready for bed, for example by producing audible instructions including "Brush your teeth" or "Put on pajamas." Similarly, for example, when a parent wishes his child to do his homework, he may send an SMS requesting homework assistance and the signal received by the toy apparatus 100 via the MMS may cause the toy apparatus 100 to encourage the child to do his homework, for example by producing instructions including "It's time for homework." Alternatively, in response to a signal from the parent's cellphone, the toy apparatus 100 may, for example, mimic movements or may display a movie or animation which aids in instructing the child to do the desired task. Optionally, the toy apparatus 100 may send feedback to the parent, for example, via an SMS to his cellphone. Alternatively, a base station transmitting signals, for example, acoustic waves, may be provided nearby and the toy apparatus 100 may receive the transmitted signals and thereby "recognizes" that the base station is operating nearby. The toy apparatus 100 may transmit to the base station signals including feedback to be transmitted immediately or later to a parent, as discussed above. In this manner, the toy apparatus 100 may act as an intermediate with parents. In the case of estranged parents, the toy apparatus 100 may communicate with both parents independently, optionally via a social worker or other professional. This may be especially important when one or both parents are remotely located relative to the child and the toy apparatus 100.

Figure 4:
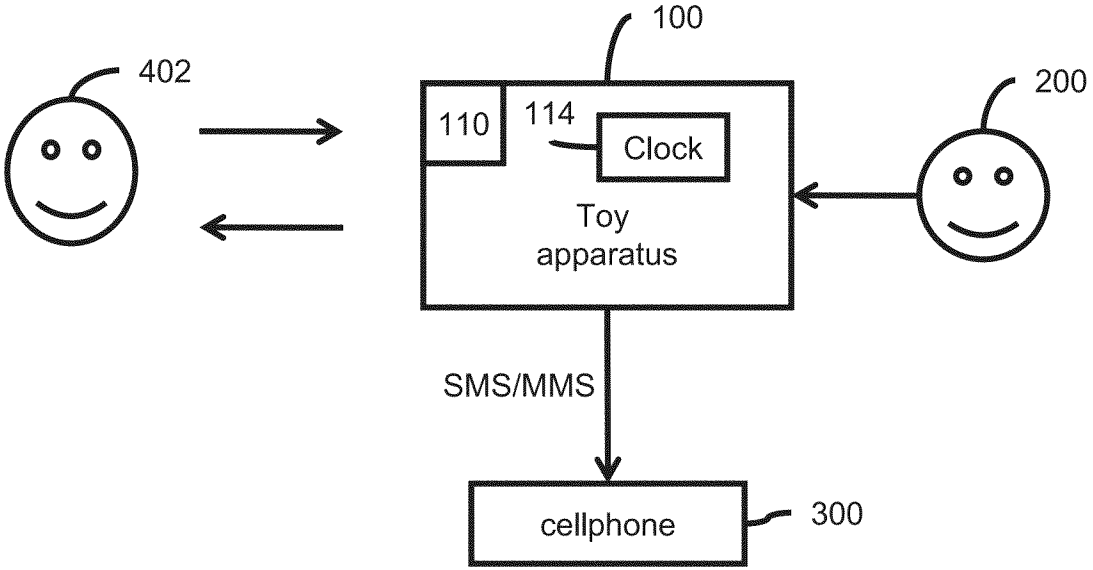
FIG. 4 is a schematic representation, wherein a toy apparatus may be utilized by an intermediary, as an educational tool, in accordance with an embodiment of the present invention.

With reference to FIG. 4, there is shown a toy apparatus according to a further embodiment of the invention, wherein the toy apparatus may be utilized as an intermediary with a teacher, aiding in the giving of guidance to the child during a class exercise. As shown, toy apparatus 100 may be configured to resemble or be placed near a book or a pencil case, as appropriate for a classroom setting, and the toy apparatus 100 may respond to signals transmitted by the child 200 and the teacher 402. In an embodiment, the toy apparatus 100 may include the clock or timer 114 which starts recording time elapsed when the teacher 402 transmits an audio signal, for example, by saying "Begin reading." When the child 200 finishes reading a preselected reading assignment, the child 200 may transmit to the toy apparatus 100 an audio signal, for example, by saying "I finished" and the amount of time elapsed may be transmitted, for example, as an audible signal, by the toy apparatus 100 to the teacher 402 and is optionally recorded in the toy memory 110 together with the date of the reading. The teacher 402 may repeat this exercise periodically and may then view recorded times of the child 200 in order to assess reading progress. As above, the toy apparatus 100 may provide feedback to the teacher 402 in the form of an SMS or MMS transmitted to the cellphone of the teacher 402. The feedback may include the recorded reading times, optionally in graphic form.

Optionally, the toy apparatus 100 is utilized as an educational tool, aiding a child to do his homework. For example, when the child begins doing homework, a signal may be transmitted to the toy apparatus 100, the signal being, for example, the child saying "homework time." In an embodiment, the toy apparatus 100 may include a timer which records elapsed time during which a child does his homework. After an amount of time preselected by a parent or teacher, the toy apparatus 100 may send an audible signal, for example saying "We did enough homework and now we can play, if you want." After an additional amount time preselected by a parent or teacher, the toy apparatus 100 may send an audible signal, for example, saying "Play time is over for now. Now back to work."

Optionally, the toy apparatus 100 is utilized to provide support to a child. This support may include responding to certain correct and incorrect behaviors, for example, offering emotional support or encouragement, optionally at a parent's or teacher's request. For example, if a child is doing his homework, using the toy apparatus 100 as discussed above, when he finishes his homework he may say, for example, "homework done" and the toy apparatus 100 may respond by transmitting a "positive" response, as discussed above. The toy apparatus 100 responses may be included in a kit obtainable from a child psychologist, and the child's behavior may be followed by the toy apparatus 100 providing feedback and sending a report to a parent or teacher, possibly remotely located relative to the toy apparatus 100.

In another example, the toy apparatus 100 may ask the child a question and may pass the answer to the teacher/parent (or other adult). Optionally, the toy apparatus 100 asks the question in response to instructions from the adult or triggered by the progression of the homework or other activity.

Use of Coupons

In some embodiments, the toy apparatus 100 may receive a signal including a code representing a coupon, the coupon entitling a user to purchase items such as, for example, accessories for the toy apparatus 100 or additional toys, at a discount. The code may be, for example, an acoustic code that activates a "sleeping" coupon already programmed into the toy apparatus 100. In this manner, when a signal including the code is received by the toy apparatus 100, the coupon may be activated. Once the coupon is activated, a user may take the toy apparatus 100 to an authorized person or device whereat the coupon may be redeemed (or the user/toy may transmit the coupon over a communication channel, such as a telephone). Alternatively, a code including a coupon may be transmitted to the toy apparatus 100, as discussed above, and a user may view the coupon by connecting the toy apparatus 100 to the Internet, such as via a USB or wireless connection. A message such as, for example, "To claim your coupon press here" may be transmitted, after which the user may receive or purchase items via the Internet.

The signal including the coupon code may be sent, for example, by a television or radio advertisement or by a store speaker system. Alternatively, the signal including a coupon code may be sent by a parent who has received the signal on his cellphone or in an email. Optionally, a parent may send a coupon to a child and, if the toy apparatus 100 has recorded more than a preselected number of points in a particular time period, as discussed above, the toy apparatus 100 may transmit an audible signal to the child such as, for example, "You did great this week. You deserve a present. Take me to the store and you'll receive a gift." Alternatively, the signal including a coupon code may be transmitted directly to the toy apparatus 100 from, for example, an incoming phone call which the toy apparatus 100 receives. Alternatively, the toy apparatus 100 may transmit an audible signal asking to receive a coupon, the audible signal being sent, for example, to a parent, after which the parent transmits a coupon to the toy apparatus 100 via a cellphone. Optionally, the toy apparatus 100 sends an audible message such as, for example, "My new car at 50% off is waiting at the store." The child may take the toy apparatus 100 to the store and may redeem the coupon thereat.

A coupon may be transmitted using a toy apparatus or another electronic device. A toy apparatus receives a transmission, such as from an advertisement, which may include an acoustic code overlaid on a television program, after which the toy apparatus may send the code to a remote location or may process it locally and use coupons based received from the signal received.

Internet Connection Using a Toy

The present invention, in some embodiments, may be particularly useful when connected with the Internet, as both may be reactive. For example, an Internet site may transmit a signal to the toy apparatus 100, the signal including information as to the state of the Internet (e.g., current site, state within site), so that appropriate feedback may be transmitted via the toy apparatus 100 to the child. Such feedback may be, for example, information from an Internet site or information prerecorded on the toy apparatus 100 or information the toy apparatus 100 may download from another location.

Figure 5:
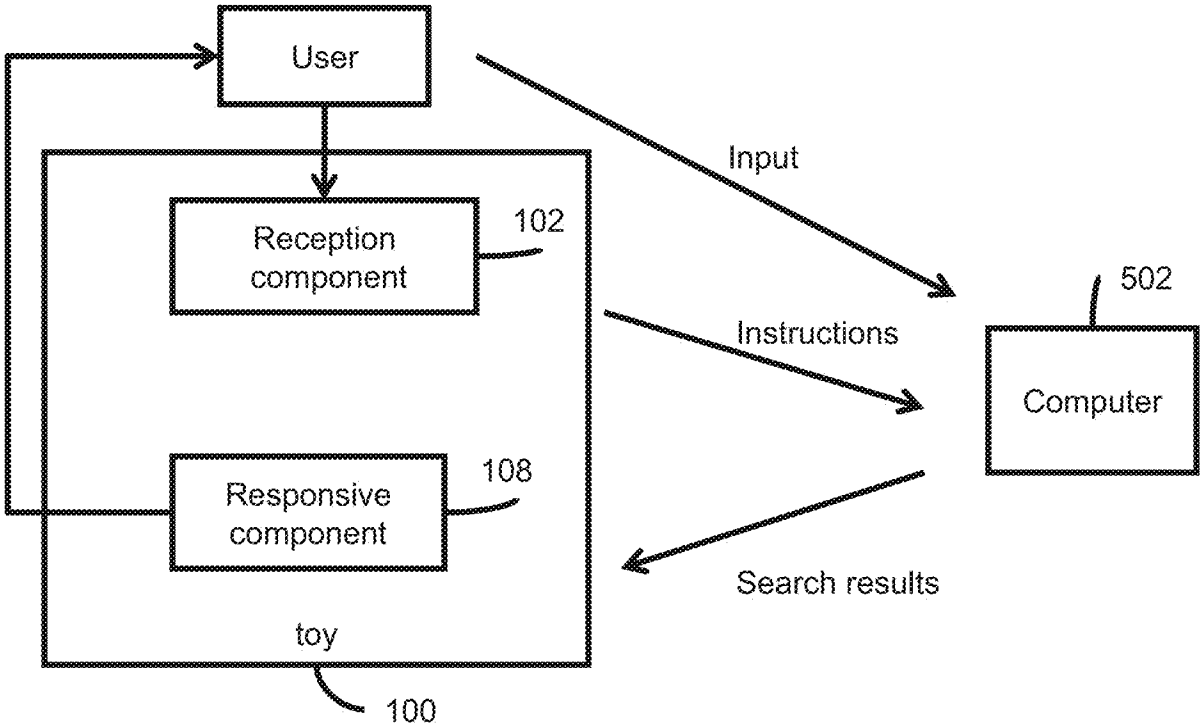
FIG. 5 is a flowchart of a method for utilizing a toy apparatus, in accordance with an embodiment of the present invention, for obtaining information from the Internet.

FIG. 5 schematically illustrates a method by which a toy apparatus may be utilized in order to aid a user, in accordance with an embodiment of the present invention, for example, obtaining information from a preselected database available on the Internet, personalizing an Internet search, or guiding a child in an Internet game site.

As shown, a toy apparatus 100 may be connected to a computer 502 by, for example, a USB connection or other wired connector (e.g., using a cable connected to or a plug mounted on the toy apparatus 100, optionally forming a part of the toy apparatus 100 such as a hair braid, a tentacle or a tail) or a Bluetooth™ connection, as known in the art, or using an acoustic connection. For personalizing an Internet search, the computer 502 may connect to a preselected search site on the Internet such as, for example, a child's version of Google™, or another search engine interface. The user may input a search question and numbered search results may be displayed on a computer display, as known in the art. The computer 502 may transmit to the toy apparatus 100 a signal including the information displayed on the screen. The user may orally communicate a first number corresponding to a first one of the search results, and this acoustic signal may be received by the toy apparatus 100, which may analyze the oral communication and respond by transmitting to the user by simulated speech a search result corresponding to the first number. The toy apparatus 100 may then transmit to the user, for example, by visual display or using audio or using a program executing on the computer 502 and communicating with the toy apparatus 100, a request for confirmation to see a Webpage corresponding to the first number. The user may then either confirm or deny the request for confirmation. If the user confirms the request, the computer 502 may navigate to the requested Webpage and the toy apparatus 100 may offer a first set of options including, for example, communicating by simulated speech the requested Webpage and storing the requested Webpage in toy apparatus memory. If the user denies the request, the toy apparatus 100 may offer a second set of options including, for example, communicating by simulated speech a request for confirmation to see a Webpage corresponding to a second number. Optionally, the toy apparatus 100 may be programmed to search specifically for topics that may be of interest to a child such as, for example, topics related to his hobbies or location. In this manner, the toy apparatus 100 may provide a more personalized approach to Internet searching for the child. Optionally, the toy apparatus 100 may be used to provide content limitations to the search engine and/or may act as a Net nanny by instructing the computer 502 to block access to certain Websites or may be required to vet a Website for the computer 502. Optionally, the toy apparatus 100 is used to instruct the computer 502 to request rating information for a Website, which information may then be sent to the toy apparatus 100 which then sends filtering instructions to the computer 502.

In accordance with a further embodiment, the toy apparatus 100 may guide a child in Internet game sites. This includes, for example, providing a child with instructions for playing a game and encouragement with good or bad game results. Optionally, the toy apparatus 100 transmits a signal to the Internet game site or to a parent if a child has been playing a game for more than a certain amount of time or past a certain time. Optionally, in response, the toy apparatus 100 transmits a signal to the child, instructing him to stop playing. Alternatively, the toy apparatus 100 may transmit a signal to the Internet game site such that the site will shut down.

In accordance with an embodiment of the present invention, the toy apparatus 100 may receive a signal including information included in an electronic mail (email) message. The email may be transmitted either directly to the toy apparatus 100 such as, for example, when the toy apparatus 100 is connected to the Internet as discussed above. Alternatively, an email may be transmitted to the toy apparatus 100 by being read out loud by a computer. The email transmitted to the toy apparatus 100 may include information which may be later transmitted, for example, to a parent such as, for example, coupon information, as discussed above.

Kits/A Plurality of Toys

In accordance with an embodiment of the invention, there is provided a toy kit including a first toy apparatus and at least one second apparatus, each of which may be configured to receive an acoustic code for initiating a game to be played by the first apparatus and the at least one second apparatus. Alternatively, a first toy may be programmed to transmit a signal, the signal detected by at least a second toy, the signal initiating a game or simulated interaction among the toys. Optionally, the first toy may be programmed to transmit the signal periodically or at specific times, until it is detected by at least a second toy and the game or simulated interaction begins. In this manner, the first toy actually may independently initiate play among toys without being operated by a child or adult.

A kit including a plurality of toys may be programmed to act as a group, which may have greater effect than a single toy, for example, in providing support to a child, as discussed above, or in acting out certain correct and incorrect behaviors, as discussed above. Also as noted above, a toy apparatus may transmit to other toy apparatuses what the child saw in a television program.

Figure 6:
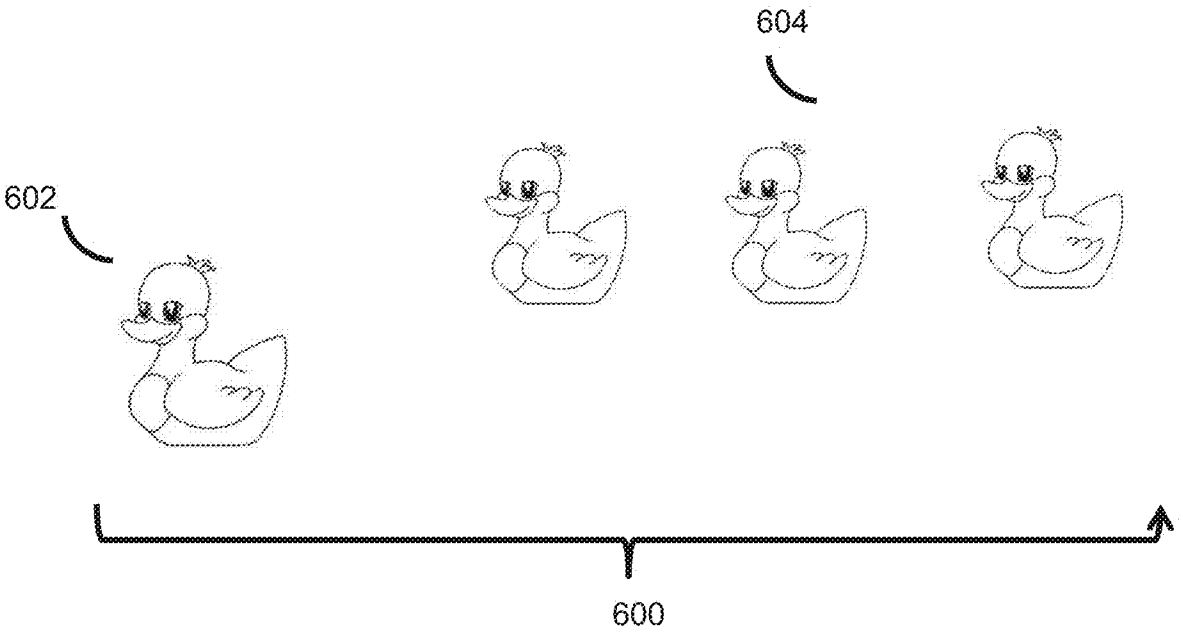
FIG. 6 is a pictorial illustration of a toy kit, in accordance with an embodiment of the present invention.

For example, FIG. 6 illustrates a toy kit, in accordance with a further embodiment of the invention. As shown, a toy kit 600 may include a mother duck toy 602 and a plurality of baby duck toys 604. The mother duck toy 602 may transmit a signal to the baby duck toys 604, the signal being, for example, an audio signal including instructions to follow, to sit, or to quack. The baby duck toys 604 may respond by, for example, following, sitting, and simulated quacking. This signal transmission and response may simulate interaction between the mother duck toy 602 and the baby duck toys 604.

In another example, a toy kit may include a teacher toy and a plurality of student toys. The teacher toy may transmit a signal to the student toys, the signal being, for example, an audio signal including instructions to stand up, to write, or to sing. The student toys may respond by, for example, standing up, writing, and simulating singing. This signal transmission and response may simulate interaction between the teacher toy and the student toy(s).

Alternatively, a toy apparatus receives a coupon, as discussed above, and may send the coupon to another toy such as, for example, to the winner of a game played by users of a plurality of toys. In this manner, in a game played by users of, for example, two toys, one of which wins and one of which loses, the losing toy may send to the winning toy a coupon and a message such as "You won. You played really well." This may encourage good sportsmanship between the users.

According to an embodiment, an acoustic code may initiate a game between users of toys in accordance with the present invention, as will be discussed below. The acoustic code may be provided, for example, over a mobile phone or via the Internet. Alternatively, the acoustic code may be transmitted from an electronic greeting card, as discussed below.

According to an embodiment, a kit may include a plurality of toys which transmit signals to each other periodically, each toy thereby signaling to each of the other toys in the kit. This results in the toys of the kit receiving signals indicating which of the toys are located within a certain distance and are turned on. If a coupon or message is sent to the kit and at least one of the toys is turned off, another one of the toys may receive the coupon or message for later transmission to the turned-off toy. As a result, the toys of a kit in effect may be aware of each other and may receive messages for each other.

Electronic Greeting Cards

It is known to provide a musical greeting card which, when opened, transmits an audible message such as, for example, a greeting or a tune composed of a plurality of musical notes produced by a module in the card.

Figure 7:
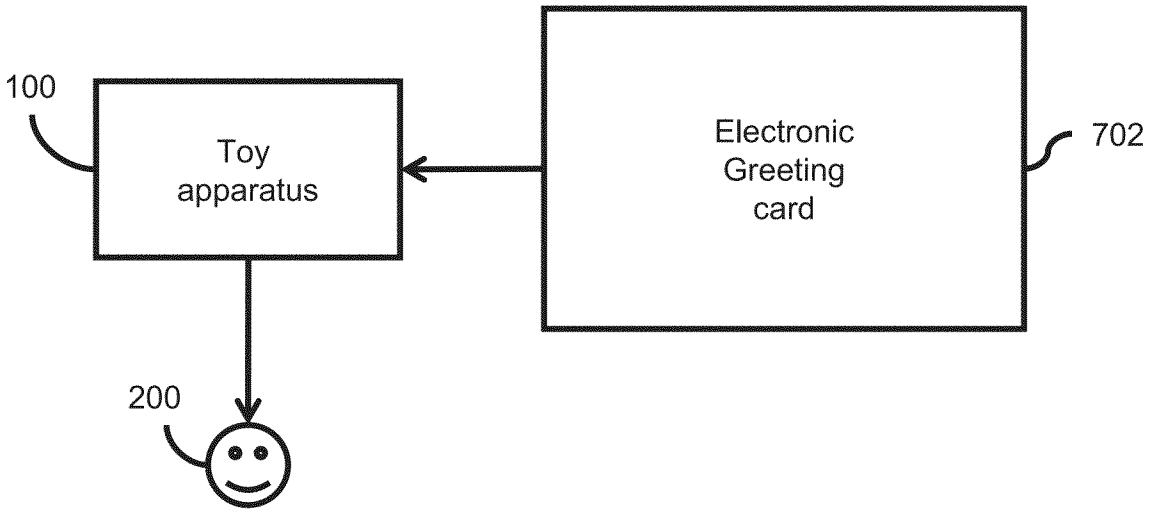
FIG. 7 is a pictorial illustration of a toy apparatus receiving a signal from an electronic greeting card, in accordance with an embodiment of the present invention.

FIG. 7 illustrates an embodiment of the represent invention, wherein an electronic greeting card may transmit a signal to toy apparatus, in accordance with the present invention. As noted above, the toy apparatus 100 may receive a signal transmitted by an electronic greeting card 702, the signal including, for example, a code embedded in a musical tune. When the toy apparatus 100 receives the transmitted code, it may produce a response, the response transmitted to the user 200.

The use of electronic greeting cards may be particularly advantageous as a way of communicating with toys, as it provides further ways for vendors to sell additional accessories to users who may be looking for new ways to interact with their toys. For example, a Christmas or birthday greeting card may transmit a corresponding signal to a toy apparatus, the toy apparatus responding by transmitting an audible signal to the user appropriate for the particular day such as, for example, "Have you been a good boy this year?" or "Happy birthday! You're really special." The types of cards that may be produced and the types of messages that may be transmitted to toy apparatuses may be substantially unlimited, thereby providing tremendous commercial opportunities for vendors, as discussed further below.

Play Between Two Users with Toys

A pair of toy apparatuses 100, each having the clock 114, the response counter 116, and/or the point counter 118 as discussed above may be utilized by two users playing a game, wherein the toy apparatuses 100 may respond to at least some signals produced by the users or by toy apparatuses 100. For example, each user may have a number of puzzles to solve during a predetermined time period. As each user solves a puzzle, he may say "Done," whereby his voice signal may be transmitted to a toy apparatus 100 which receives the voice signal and responds, for example, by saying "Good" and adding a point to the corresponding point counter. For each player, if the number of points recorded in a preselected time period is more than a preselected number, for example 25 points, his toy apparatus 100 may responds, for example, by flashing lights, by ringing bells, by saying "You win!," or by a combination thereof.

According to another embodiment of the present invention, a user may send an SMS with the word "WAR" to a dedicated cellphone number associated with a service. In response, the service may send back an SMS or MMS that may be transmitted to the toy apparatus 100 of the user. The toy apparatus 100 may initiate play by transmitting a signal, thereby "looking" for another toy with which to play. Once at least a second toy apparatus receives the signal, a game may be started, for example, transmitting audible signals simulating explosions and other sounds associated with a war. The rules of the game may be preprogrammed into the toy apparatuses 100 or may be transmitted by one of the toy apparatuses to the other toy apparatuses, and at least one toy apparatus 100 may record time elapsed from the beginning of play and/or points for each toy for achieving certain goals. The toy apparatuses 100 may continue play for a preselected period of time or until one toy has recorded a preselected number of points, after which a winning toy apparatus may be determined. The winning toy apparatus may accrue points to be recorded in its memory and thereby may become "stronger and more powerful."

Also in other games, the toy apparatus may transmit "abilities" (such as power, lives, spells) to another toy apparatus. Such abilities may be commonly used in multi-player role playing games. Optionally, the toy apparatus is used as a proxy in such a game. Optionally, the abilities are encoded and/or digitally signed, so that the abilities cannot be easily duplicated.

Figure 8:
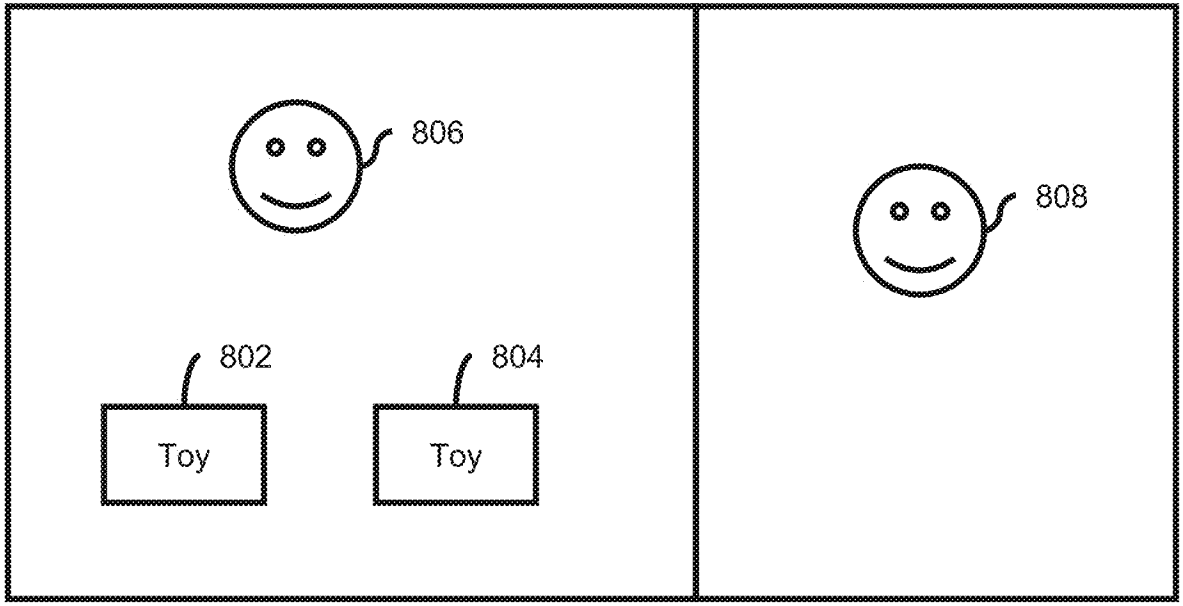
FIG. 8 is a pictorial illustration of two toy apparatuses being utilized by two users, in accordance with an embodiment of the present invention.

It should be noted that, in the case of a signal transmitted by a PC, a voice signal may be digitized or converted into a digital communication for transmission to the toy apparatus 100. Therefore, since signals may be transmitted via a cellphone or a PC to and from each toy apparatus, the users do not necessarily need be located next to the toy apparatuses. For example, as illustrated in FIG. 8, two toy apparatuses may be utilized by two users, in accordance with an embodiment of the present invention. As shown in the drawing, toy apparatuses 802 and 804 may be near a first user 806, and a second user 808 may be located remote from the first user 806. In this manner, each of the two toy apparatuses 802 and 804 may count points for a corresponding one of the users 806 and 808. While each user independently may solve puzzles, for example, at remote locations relative to each other, "his" toy apparatus may record the number of puzzles solved and count his points, regardless of his location relative to his toy apparatus. In this manner, a first child may have two toy apparatuses and a second child may not have a toy apparatus, yet both children may play a game as if each has a toy apparatus of his own.

Acquiring Alternative/Additional Programming

As discussed above, the toy apparatus 100 may be responsive to a preselected set of signals and/or may provide a response chosen from a preselected set of responses. The toy apparatus 100 may be preprogrammed with a limited set of signals which the toy apparatus 100 recognizes and for which the toy apparatus 100 produces corresponding responses. For example a particular toy apparatus may recognize 50 specific signals and may respond thereto with 50 responses, such as discussed above. The signals and responses may be chosen according to a toy apparatus's use such as, for example, as an educational aid, discussed above.

Optionally, the toy apparatus 100 may be provided with alternative programming such that, for example, it may respond differently to some or all of the signals it recognizes. For example, alternative programming may allow the toy apparatus 100 to respond differently to a specific 25 of the 50 signals.

Alternatively or additionally, the toy apparatus 100 may be provided with add-on programming. Add-on programming may provide the toy apparatus 100 with the ability to recognize additional signals and to respond thereto with additional corresponding responses. For example, add-on programming may provide the toy apparatus 100 with the ability to respond to an additional 30 signals with an additional 30 corresponding responses. A method by which the toy apparatus 100, in accordance with an embodiment of the invention, may acquire additional and/or add-on programming is described below.

A user may transmit an SMS to a central base station, the SMS including a code and a request for additional or add-on programming. In response, the central base station may generate a signal specific to the toy apparatus 100, the signal including a code. The toy apparatus 100 may receive the code and the user may connect the toy apparatus 100 to the Internet, as discussed above. Optionally, prior to connecting the toy apparatus 100 to the Internet, the toy apparatus 100 transmits an audible signal simulating a request to be connected to the Internet. For example, the toy apparatus 100 may transmit an audible signal such as "I want new programming. Please connect me to the Internet." Once connected to the Internet, the additional or add-on programming may be transmitted to the toy apparatus 100.

Alternatively, additional or add-on programming may be provided, for example, in response to a parent's request, via an MMS sent to a parent's cellphone, as discussed above.

Alternatively, additional or add-on programming may be provided in response to a code transmitted to the toy apparatus 100, for example, from a television program, from a DVD, from an electronic greeting card or an audio-playing card, from an MP3 file, or during an IVR (interactive voice response)-type interaction with a child such as, for example, an Internet search, as discussed above. As a result, the toy apparatus 100 may respond to additional signals, or the toy apparatus 100 may respond differently to certain signals, depending on the additional or add-on programming that has been acquired.

AN IVR sequence may be provided in other embodiments as well.

Exemplary Commercial Opportunities

As discussed above, by directing a communication at the toy apparatus 100, the toy apparatus 100 may receive signals from one of various sources including electronic greeting cards and codes sent by cellphone or via the Internet. A user of the toy apparatus 100 may have a limited number of ways of playing with or otherwise utilizing his toy apparatus(s), depending on which signals may be received and responded to by his toy apparatus(s). The number of options available to a user in utilizing his toy apparatus(s) may be increased, as discussed above, by purchasing additional toy apparatuses, optionally to be used in games and in kits with existing toys; by purchasing additional or add-on programming; and by purchasing toy accessories. Additionally as discussed above, other options may become available by purchasing electronic greeting cards which include codes transmitted to and received by toy apparatuses; by purchasing services that generate codes to be sent via, for example, a cellphone or the Internet; and by purchasing software that creates messages to be sent to toy apparatuses.

It should be noted that options available to users may be limited and as a result the toy apparatus 100 may have an overly limited ability. For example, a user may purchase a package of, for example, 50 messages to be sent to the toy apparatus 100, each message transmittable only once. Optionally, options available to users may be reduced and as a result the toy apparatus 100 may have reduced ability. For example, a user may purchase an option whereby the toy apparatus 100 receives a signal initiating a particular level of play and, in order to play at a different level, the user must purchase an additional option. Optionally, the toy apparatus 100 transmits an audible message such as, for example, "You've reached level 10 and have passed your basic training. To play at a higher level and go for professional status you need to purchase levels 11-20." By utilizing these vending strategies, a user may be encouraged to purchase additional options, either at the same time or at a later time, in order to provide the toy apparatus 100 with additional capabilities for play.

These optional purchases may be increasingly desirable for toy apparatus users, as they discover more ways to utilize their toy apparatuses. This may translate into an enormous commercial opportunity for manufacturers and suppliers of these toy apparatuses and accessories, coded greeting cards, code-generating services, message-creating software, etc.

Figure 9:
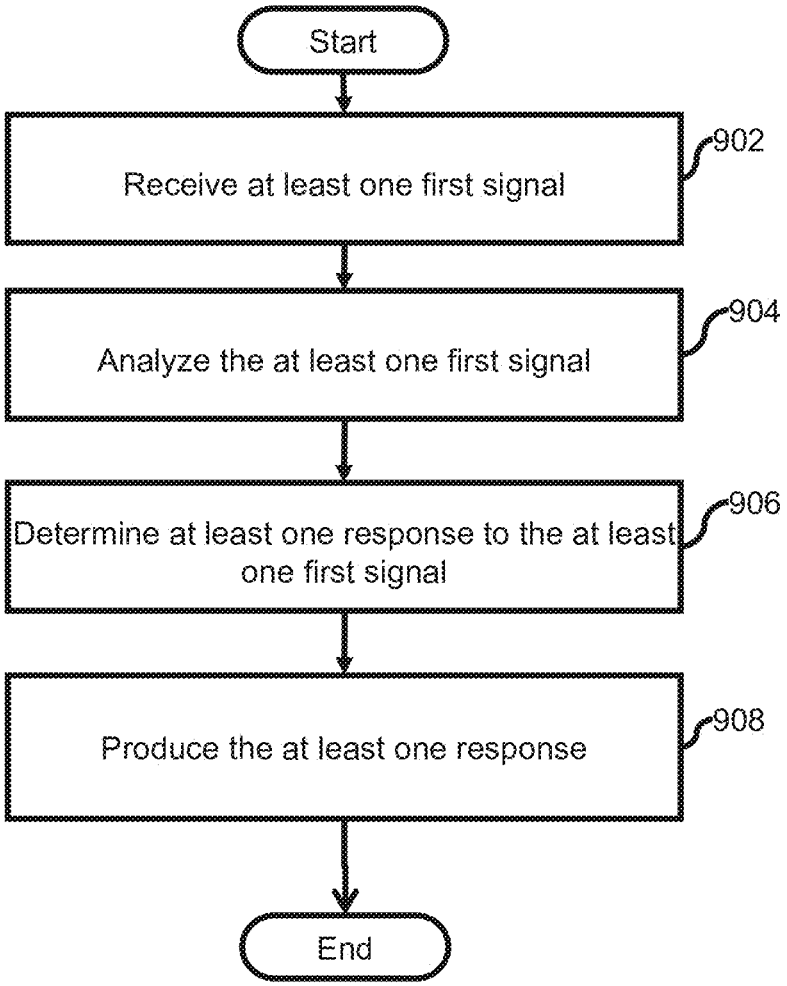
FIG. 9 is a flowchart of a method for interactive communication with a toy apparatus, in accordance with an embodiment of the present invention.

FIG. 9 is a flowchart of a method for interactive communication with a toy apparatus, in accordance with an embodiment of the present invention. As seen in the drawing, at 902, the toy apparatus 100 may receive at least one first signal. Examples of the at least one first signal include, but are not limited to an acoustic signal, a tactile signal, a Bluetooth signal, a Wi-Fi signal, a Z-wave signal, Zigbee signal, an Infrared signal, a GPRS (general packet radio service) signal, a 3G signal, an SMS, an email message, an NFC (Near Field Communication) signal and an RFID (Radio Frequency Identification) signal. In an embodiment of the present invention, the at least one first signal may be received from a communication device. Examples of the communication device include, but are not limited to, a cellphone, an Internet server, a computer, a laptop, a PDA (Personal Digital Assistant), a tablet PC, a phone, a controller, another toy apparatus and a music player. In an embodiment, the controller may be a home automation controller, communicating with the toy apparatus 100 via Zigbee/Z-wave signals. In another embodiment of the present invention, the controller may be a NFC reader. The NFC reader may be capable of communicating with the toy apparatus 100 via NFC.

In an embodiment of the present invention, the at least one first signal may contain data. Examples of the data include, but are not limited to, data transmitted by an electronic greeting card, a coupon code, a ringtone, music data and Internet data. A coupon code may be redeemed through a plurality of redemption means such as, for example, a discount for a new toy. Further, the coupon code may be either a one-time use coupon code or a multiple-time use coupon code. In the case of the electronic greeting card, this may be an audio greeting card, a video greeting card or a multimedia greeting card. In the case of the Internet data, this may be Website data. The toy apparatus 100 may access the Internet data by coupling to an Internet-enabled device. In an embodiment of the present invention, the at least one first signal may be pre-programmed into the toy apparatus to be received at a predetermined time. For example, the at least one first signal may be programmed to be received at a pre-specified time like a birthday, and the response may be a birthday greeting sent by the toy apparatus 100 to the user.

At 904, the at least one first signal may be analyzed. As noted above, such analysis may be done by any one of a variety of methods, including, for example, one or more of using a look-up table, signal processing methods, pattern matching methods, signal parsing and interactive communication with the signal sender to confirm its content. Optionally or alternatively, signal processing may include choosing from a list of options. Based on the analysis, at least one response may be determined at 906. In an embodiment of the present invention, the at least one response may include at least one second signal. The at least one second signal may be transmitted to the communication device, to one or more toy apparatuses and to one or more other communication devices. In an embodiment of the present invention, the at least one response may be an audible response, a transmission of information, storage of information, a mechanical response, an activity, or a behavior. Examples of the activity include, but are not limited to, reading a message, playing a ringtone, playing an electronic greeting card and playing music. Examples of the behavior include, but are not limited to, a smile, a movement and a frown. In an embodiment of the present invention, the at least one response may be re-programming the toy apparatus. Finally, at 908, the at least one response may be produced.

Figure 10:
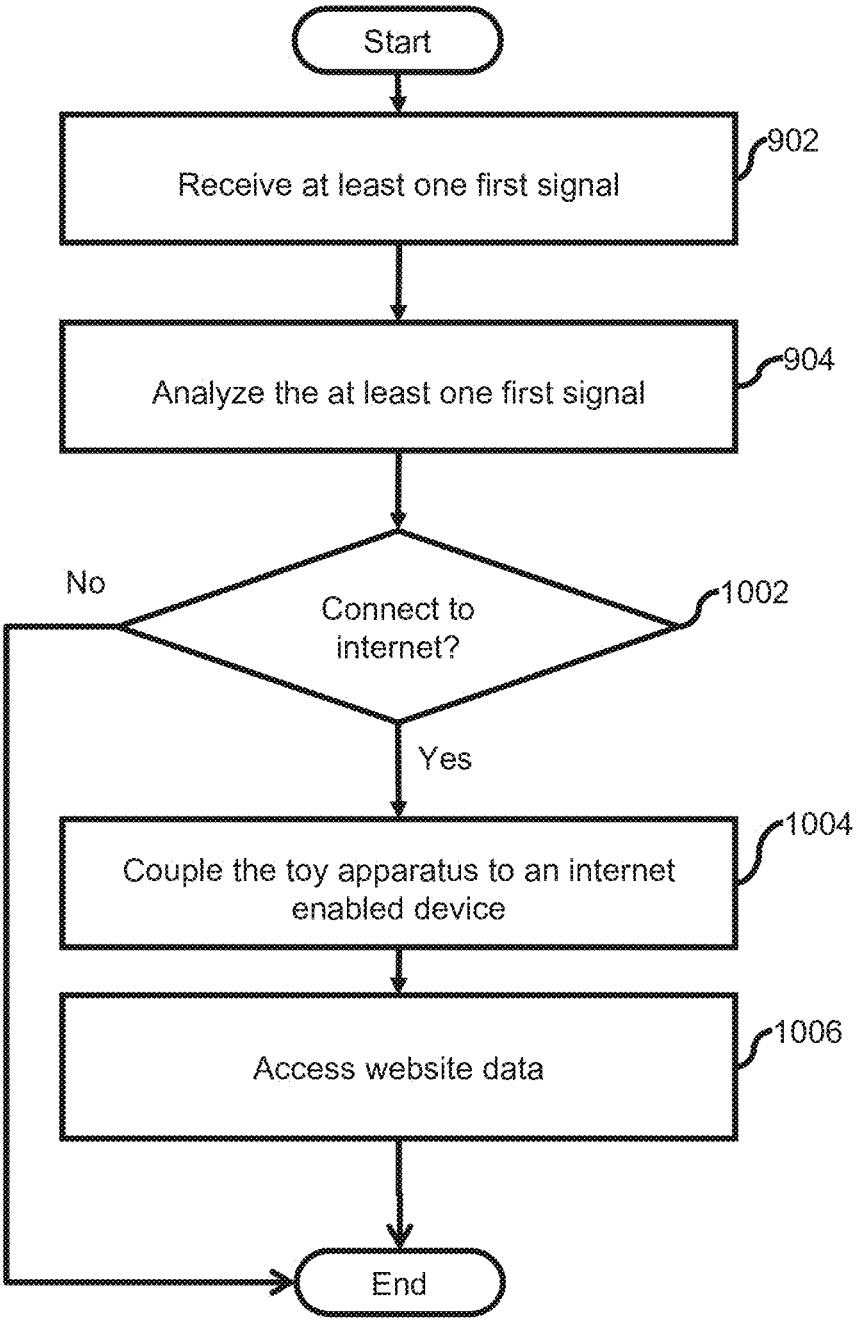
FIG. 10 is a flowchart of a method for interactive communication with a toy apparatus, in accordance with another embodiment of the present invention.

FIG. 10 is a flowchart of a method for interactive communication with a toy apparatus, in accordance with another embodiment of the present invention. As shown, at 902, the toy apparatus 100 may receive at least one first signal. Examples of the at least one first signal includes but is not limited to an acoustic signal, a tactile signal, a Bluetooth signal, a Wi-Fi signal, a Z-wave signal, a Zigbee signal, an Infrared signal, a GPRS signal, a 3G signal, an SMS, an email message, an NFC signal and an RFID signal. At 904, the at least one first signal may be analyzed, as discussed above. At 1002, it may be determined whether the at least one first signal contains a request to access Internet data. If so, at 1004, the toy apparatus 100 may be coupled to an Internet enabled device to access the Internet data. At 1006, the toy apparatus may access the Internet data.

Figure 11:
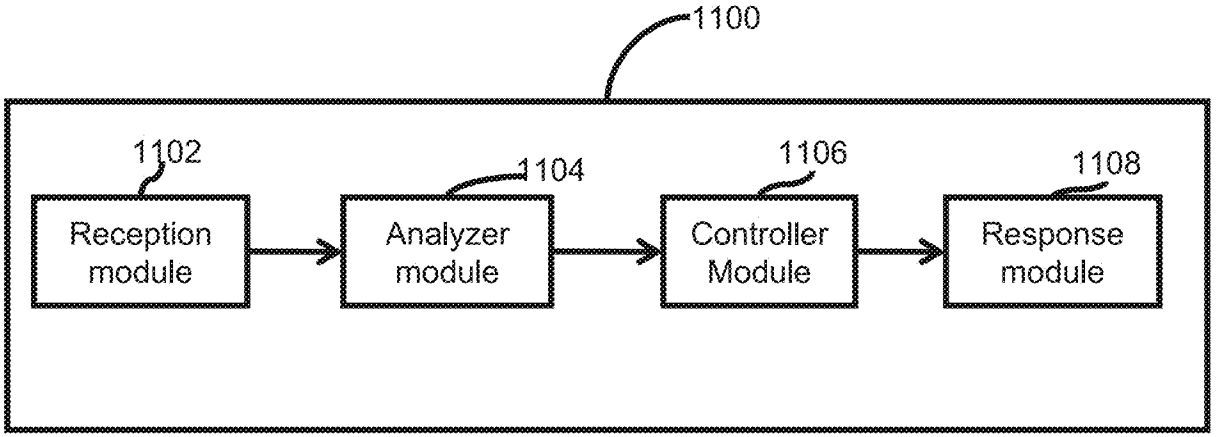
FIG. 11 is a block diagram of a system for interactive communication with a toy apparatus, in accordance with an embodiment of the present invention.

FIG. 11 is a block diagram of a system for interactive communication with a toy apparatus, in accordance with an embodiment of the present invention. Shown is a system 1100 which may be present in the toy apparatus 100. The system 1100 may include a reception module 1102, an analyzer module 1104, a controller module 1106 and a response module 1108. The reception module 1102 may be capable of receiving at least one first signal, examples of which are discussed above. In an embodiment of the present invention, the at least one first signal may be received from a communication device. Examples of the communication device include, but are not limited to, a cellphone, an Internet server, a computer, a laptop, a PDA, a tablet PC, a phone, a controller, another toy apparatus and a music player. In an embodiment, the controller may be a home automation controller, and communication with the toy may be via Zigbee/Z-wave signals.

In an embodiment of the present invention, the at least one first signal may contain data. Examples of the data include, but are not limited to, data contained in an electronic greeting card, a coupon code, a ringtone, music data and Internet data. In case of a coupon code, the coupon code may be redeemed through a plurality of redemption means, such as a discount for a new toy, as noted above. Further, the coupon code is optionally a one-time use coupon code or a multiple-time use coupon code. In case of the electronic greeting card, this may be an audio greeting card, a video greeting card or a multimedia greeting card. In case of the Internet data, this may be Website data. The toy apparatus 100 may access the Internet data by coupling to an Internet-enabled device. In an embodiment of the present invention, the at least one first signal may be pre-programmed into the toy apparatus to be received at a predetermined time. For example, the at least one first signal may be programmed to be received at a pre-specified time like a birthday, and the response may be a birthday greeting transmitted by the toy apparatus 100.

The analyzer module 1104 may be capable of analyzing the at least one first signal, as discussed above. Further, the controller module 1106 may determine at least one response based on the analysis. In an embodiment of the present invention, the at least one response may include at least one second signal. The at least one second signal may be transmitted to the communication device, to one or more toy apparatuses and to one or more other communication devices. In an embodiment of the present invention, the at least one response may be one or more of an audible response, a transmission of information, storage of information, a mechanical response, an activity, and a behavior. Examples of the activity may include, but are not limited to, reading a message, playing a ringtone, playing an electronic greeting card and playing music. Examples of the behavior may include, but are not limited to, a smile, a movement and a frown. In an embodiment of the present invention, the at least one response may be re-programming of the toy apparatus. Finally, the response module 1108 may produce the at least one response.

Figure 12:
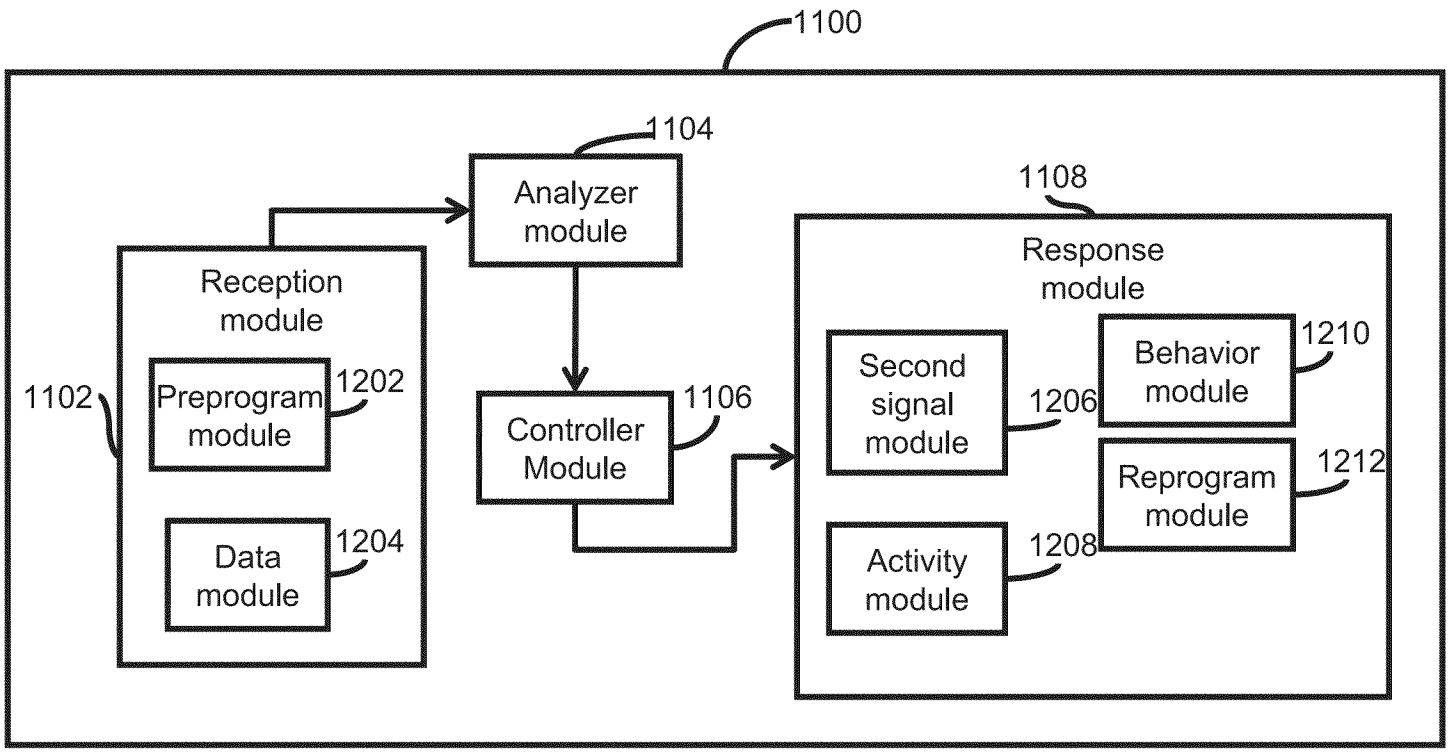
FIG. 12 is a block diagram of a system for interactive communication with a toy apparatus, in accordance with another embodiment of the present invention.

FIG. 12 is a block diagram of a system for interactive communication with a toy apparatus, in accordance with another embodiment of the present invention. There is shown a system 1100 which may be present in the toy apparatus 100. The system 1100 may include the reception module 1102, the analyzer module 1104, the controller module 1106 and the response module 1108, as noted above.

The reception module may include a pre-program module 1202 and a data module 1204. The pre-program module may pre-program at least one first signal into the toy apparatus to be received at a predetermined time. For example, the at least one first signal may be programmed to be received (e.g., actively sought after, for example, by asking to be connected to an internet) at a pre-specified time like a birthday, and the response may be a birthday greeting transmitted by the toy apparatus 100. The data module 1204 may receive the data contained in the at least one first signal. Examples of the data include, but are not limited to, data contained in an electronic greeting card, a coupon code, a ringtone, music data and Internet data, as noted above.

The response module 1108 may include a second signal module 1206, an activity module 1208, a behavior module 1210, and a reprogram module 1212. In an embodiment of the present invention, the at least one response may include at least one second signal. The second signal module 1206 may transmit the at least one second signal to the communication device, to one or more toy apparatuses and to one or more other communication devices. The activity module 1208 may produce an activity response. Examples of the activity include, but are not limited to, reading a message, playing a ringtone, playing an electronic greeting card and playing music. The behavior module 1210 may produce a behavior response. Examples of behavior responses include, but are not limited to, a smile, a movement and a frown. The reprogram module 1212 may reprogram the toy apparatus.

Figure 13:
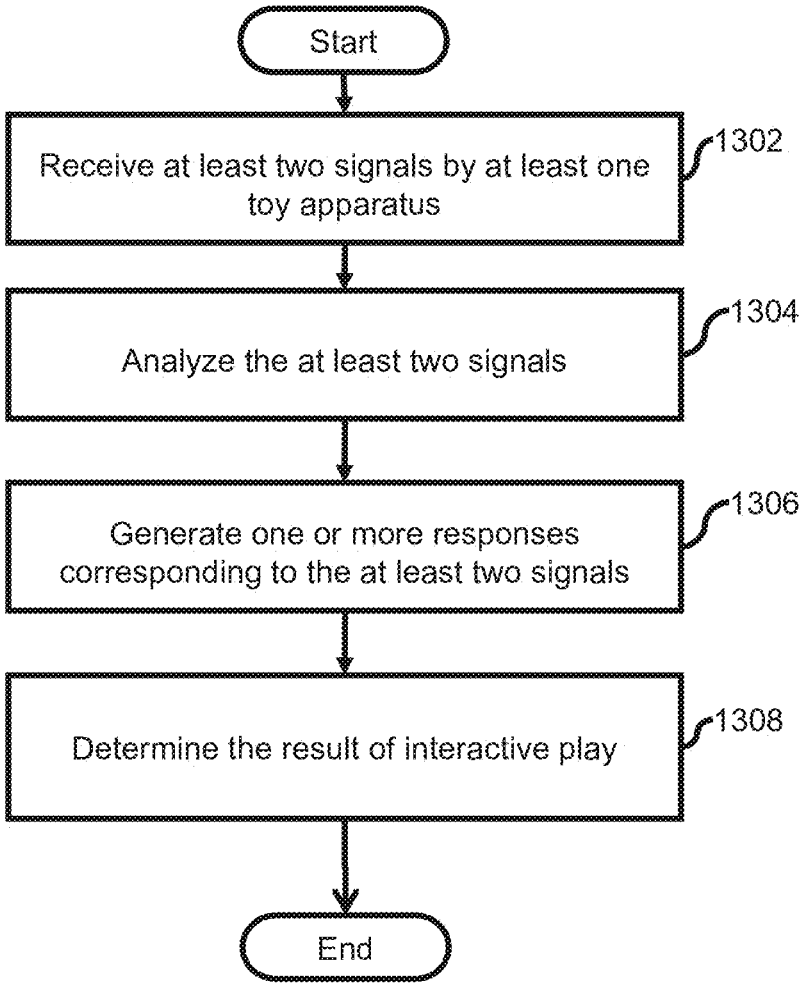
FIG. 13 is a flowchart of a method for interactive play between at least two users, in accordance with an embodiment of the present invention.

FIG. 13 is a flowchart of a method for interactive play between at least two users, in accordance with an embodiment of the present invention. According to the method, each of at least two users may be associated with at least one toy apparatus. At 1302, the at least one toy apparatus may receive at least two signals, one from each of the at least two users. In an embodiment, each of the at least two signals may be received from at least two communication devices.

In an embodiment of the present invention, each of the at least two users may be associated with a separate toy of the at least one toy. At 1304, the at least two signals may be analyzed, as discussed above. Further, at 1306, one or more responses corresponding to the at least two signals may be generated. In an embodiment, the one or more responses may include awarding one or more points to the at least two users. In an embodiment, one or more point counters for each player of the at least two players may be maintained. Further, it may be determined whether a point counter of the one or more point counters has reached a predetermined first threshold. In another embodiment, elapsed time from start of the interactive play may be determined. Further, the interactive play may be stopped/ended when the elapsed time reaches a predetermined second threshold. Finally, at 1308, the result of the interactive play may be determined. In an embodiment, the result comprises generating a winning signal, the winning signal being generated when a point counter reaches the predetermined first threshold. In another embodiment, the winning signal may be generated, based on the higher number of points generated by one of the at least two users, when the elapsed time reaches the predetermined second threshold.

Figure 14:
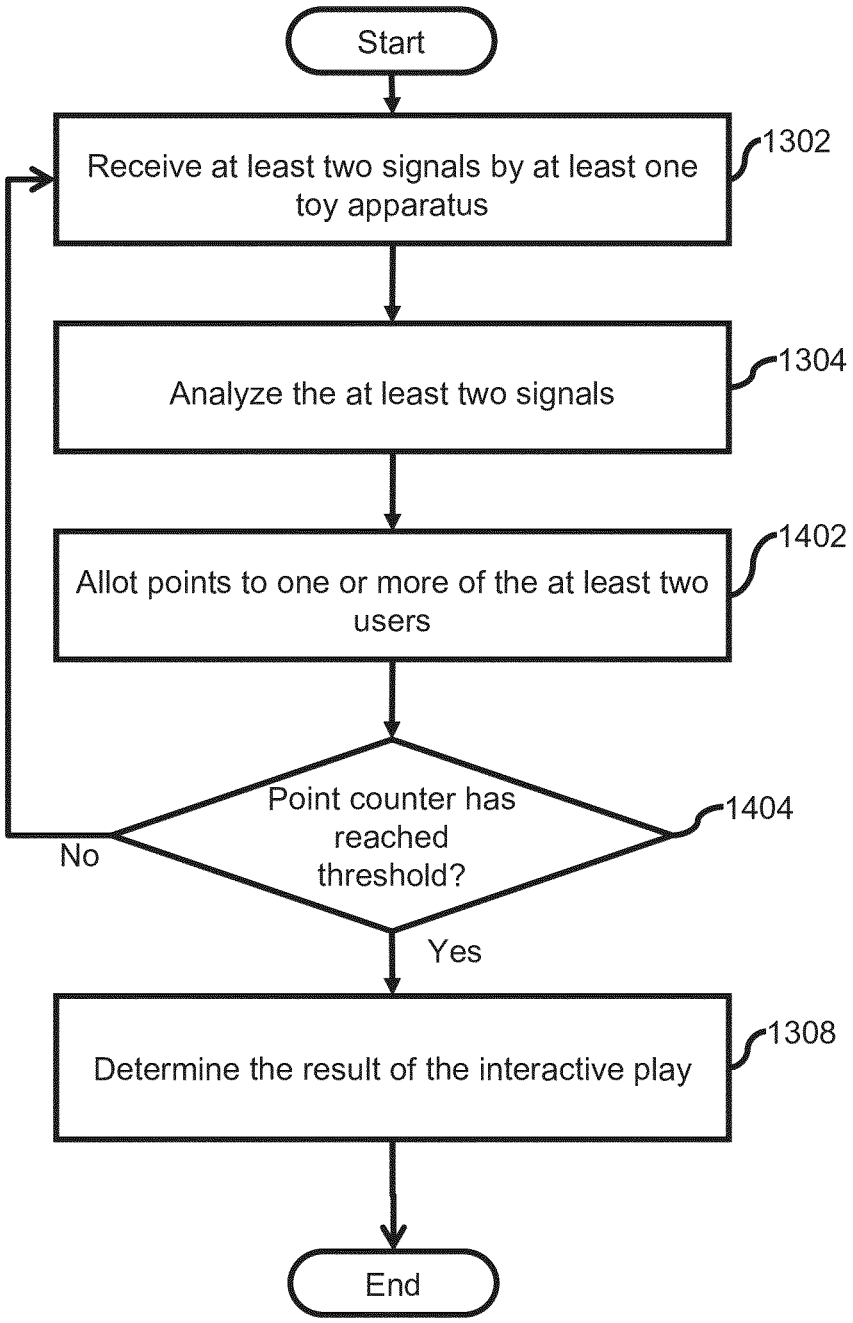
FIG. 14 is a flowchart of a method for interactive play between at least two users, in accordance with another embodiment of the present invention.

FIG. 14 is a flowchart of a method for interactive play between at least two users, in accordance with another embodiment of the present invention. The interactive play may be performed by at least one toy apparatus, each of the at least two users being associated with the at least one toy apparatus. As shown in the drawing, at 1302, the at least one toy apparatus may receive at least two signals, where the at least two signals may correspond to the at least two users, respectively. At 1304, the at least two signals may be analyzed, as discussed above. At 1402, points may be allotted to one or more of the at least two users. At 1404, it may be determined whether the points allotted have reached a pre-specified threshold. Finally, at 1308, the result of the interactive play may be determined.

Figure 15:
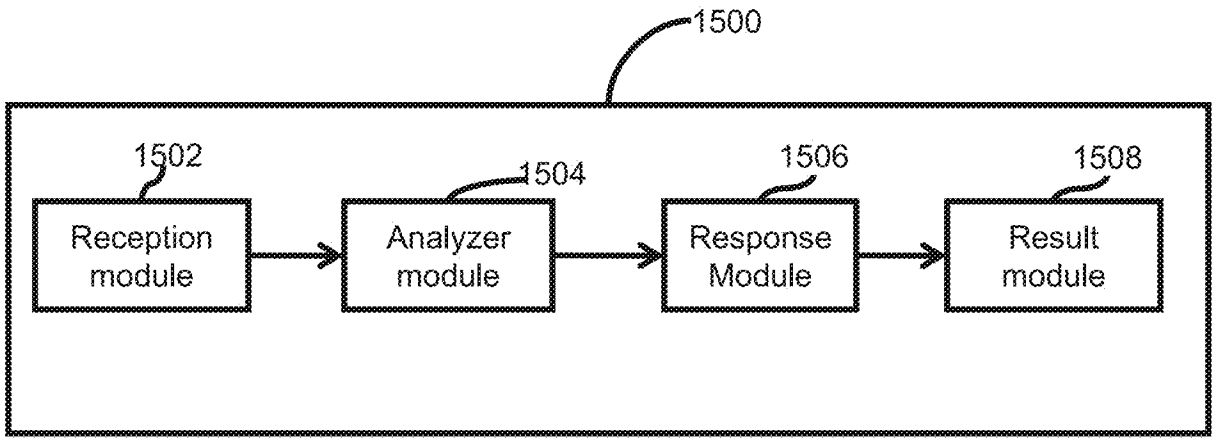
FIG. 15 is a block diagram of a system for interactive play between at least two users, in accordance with an embodiment of the present invention.

FIG. 15 is a block diagram of a system for interactive play between at least two users, in accordance with an embodiment of the present invention. According to this embodiment, each of the at least two users may be associated with at least one toy apparatus. In an embodiment of the present invention, each of the at least two users may be associated with a separate toy of the at least one toy apparatus. There is shown a system 1500 which includes a reception module 1502, an analyzer module 1504, a response module 1506 and a result module 1508. The reception module 1502 may receive at least two signals, where the at least two signals may correspond to the at least two users, respectively. Further, the analyzer module 1504 may analyze the at least two signals. Then the response module 1506 may generate one or more responses corresponding to the at least two signals. Finally, the result module 1508 may determine the result of the interactive play.

Figure 16:
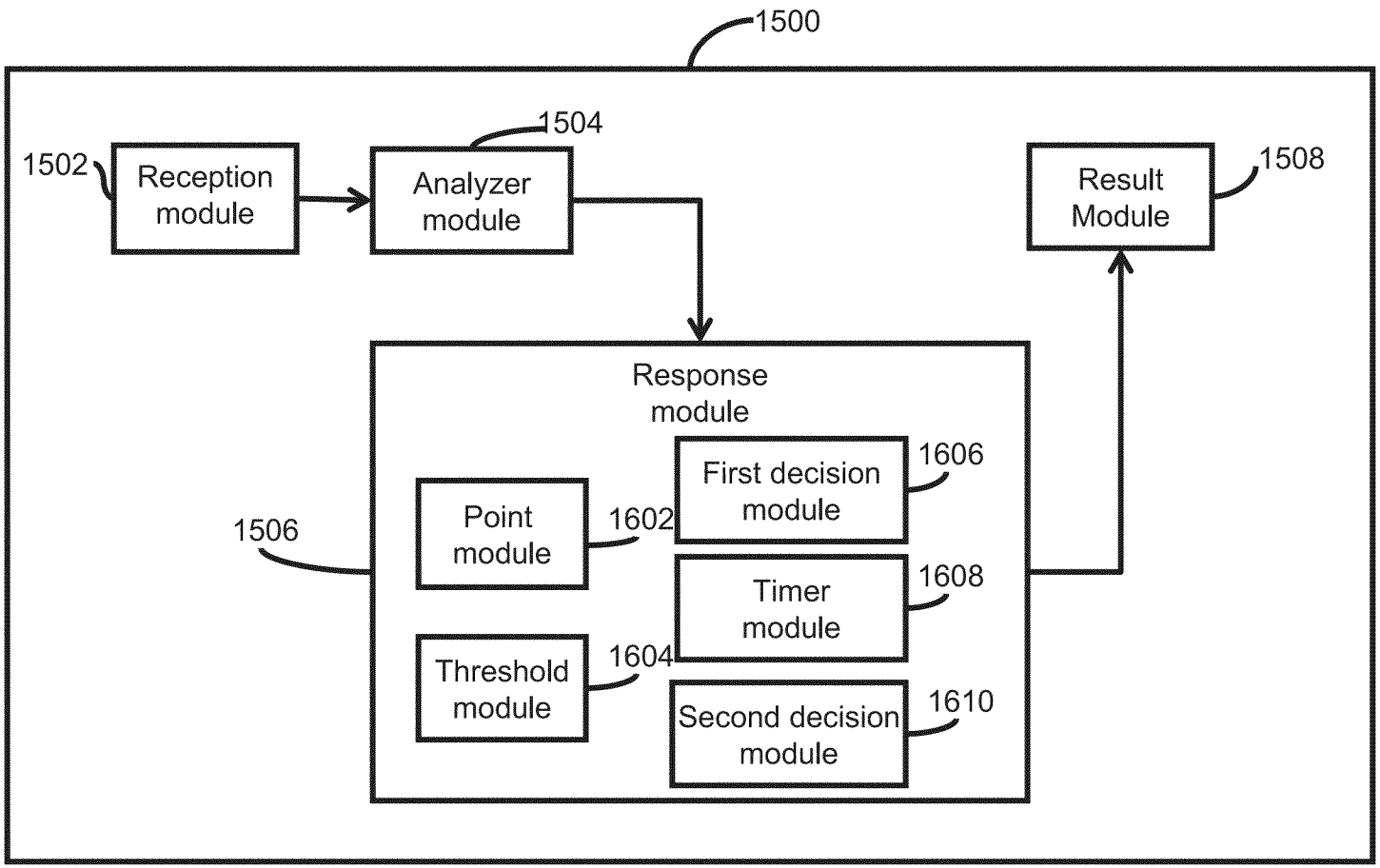
FIG. 16 is a block diagram of a system for interactive play between at least two users, in accordance with another embodiment of the present invention.

With further reference to FIG. 16 there is shown a block diagram of a system for interactive play between at least two users, in accordance with another embodiment of the present invention. According to this embodiment, each of the at least two users may be associated with the at least one toy apparatus. There is shown a system 1500 including a response module 1506 which includes a point module 1602, a threshold module 1604, a first decision module 1606, a timer module 1608, and a second decision module 1610. In an embodiment of the present invention, the point module 1602 may maintain one or more point counters for each player of the at least two players. The threshold module 1604 may determine if a point counter of the plurality of point counters has reached a predetermined first threshold. Finally, the first decision module 1606 may generate a winning signal, when a point counter reaches the predetermined first threshold. In another embodiment of the present invention, the timer module 1608 may determine elapsed time from start of the interactive play. Further, the timer module 1608 may include a stop module for ending the interactive play when the elapsed time reaches a predetermined second threshold Finally, the second decision module 1610 may generate a winning signal, the winning signal being generated based on the higher number of points generated by one of the at least two users, when the elapsed time reaches the predetermined second threshold.

Location Based Services

Figure 17:
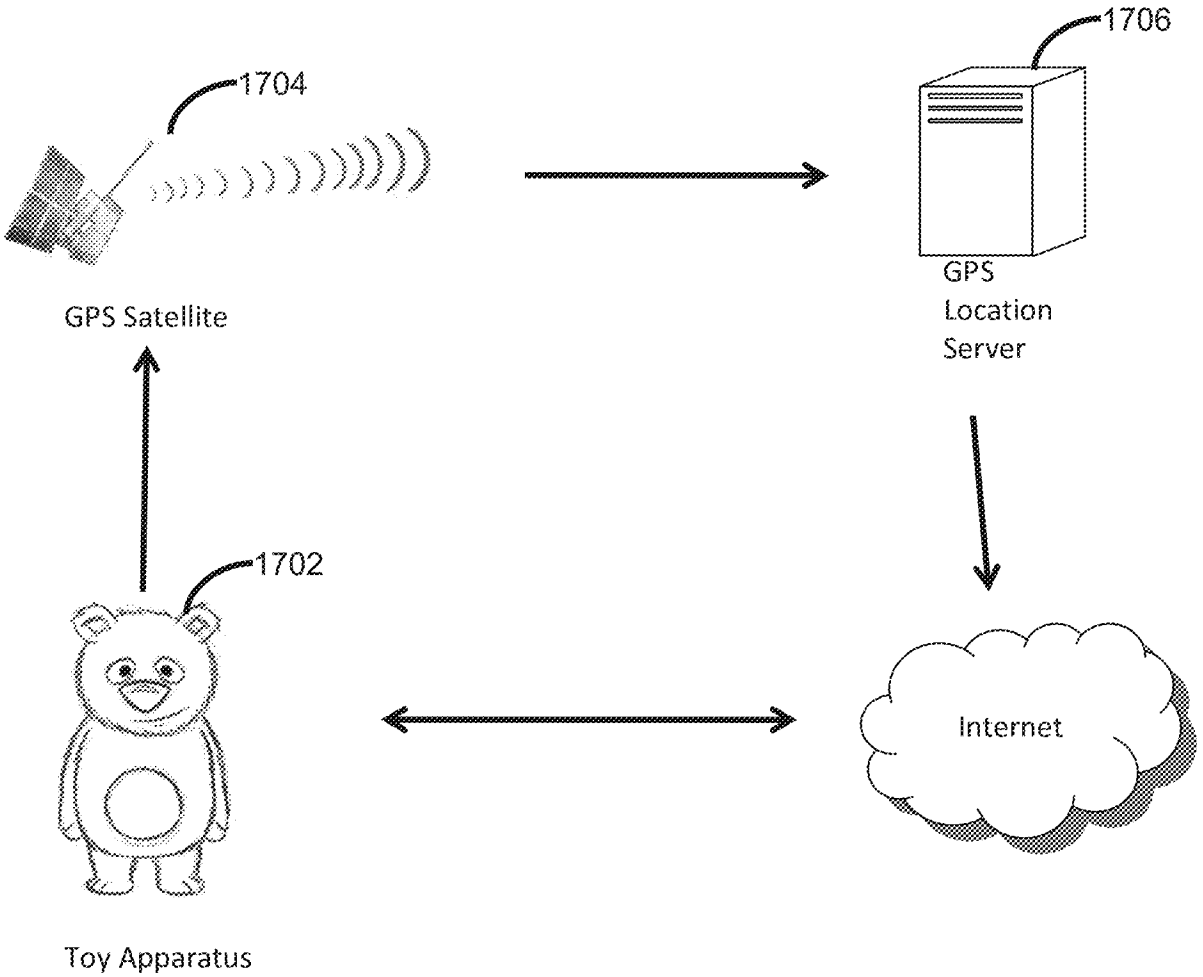
FIG. 17 illustrates a toy apparatus receiving location based services via GPS (Global Positioning System) location detection, in accordance with another embodiment of the present invention.

The toy apparatus 100 may be capable of acting differently based on its position. Optionally or alternatively, the toy may be provided with location based services. In an embodiment of the present invention, the toy apparatus may receive (or transmit) coupon codes based on its location. FIG. 17 illustrates a toy apparatus acting in a location based manner using GPS location detection. As seen in the drawing, a toy apparatus 1702 may include a GPS chip. The GPS chip may be capable of transmitting a location of the toy apparatus 1702 via GPS satellites 1704 to a GPS location server 1706. Based on the location of the toy apparatus, relevant data may be sent to the toy apparatus 100 via an Internet. For example, a coupon code of a nearby toy store may be sent to the toy apparatus 1702. Optionally or alternatively, a toy may interpret data and/or commands responsive to the position. Optionally or alternatively, the location or a location indication may be transmitted to the toy, for example, as part of a data message.

Figure 18:
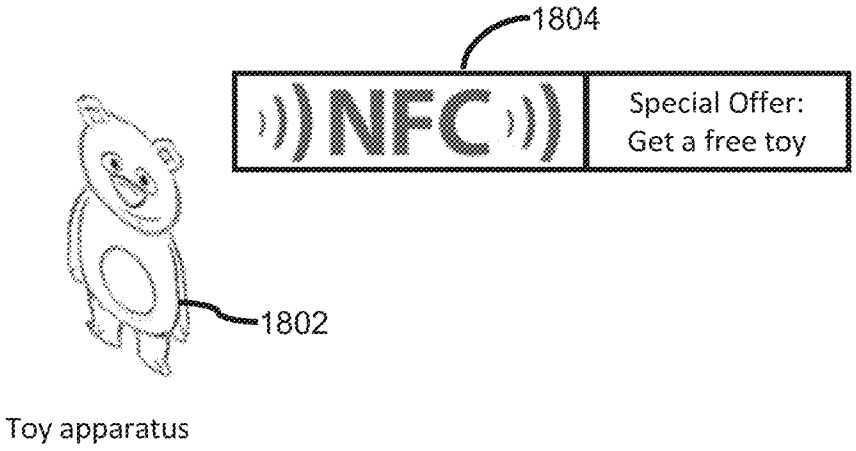
FIG. 18 illustrates a toy apparatus being tapped at a NFC reader, in accordance with an embodiment of the present invention.

In another embodiment of the present invention, the coupon code may be sent to the toy apparatus 100 when the toy apparatus 100 is tapped at a NFC device, e.g., a pre-defined or pre-programmed NFC reader. NFC readers may be installed at multiple locations. For example, an NFC reader installed at a toy store may send coupon codes related to the toy store. Optionally, the NFC reader sends location information to the toy. Optionally or alternatively, a cellular telephone or other electronic device is used to mediate between the toy and the NFC reader, the telephone serving to pass messages from the NFC reader to the toy and/or back. Such mediation may be provided with other embodiments of the invention as well. FIG. 18 shows a toy apparatus being tapped at an NFC reader to get a special offer, in accordance with a further embodiment of the invention. There is shown a toy apparatus 1802 being tapped at an NFC reader 1804. On receiving the offer, the toy apparatus 1802 may read out the received offer or display the received offer to a user of the toy apparatus 1802. Such display may be time delayed (e.g., seconds, minutes or days), location based and/or in response to later activity such as performing homework, receiving an SMS or hearing a greeting card.

Figure 19:
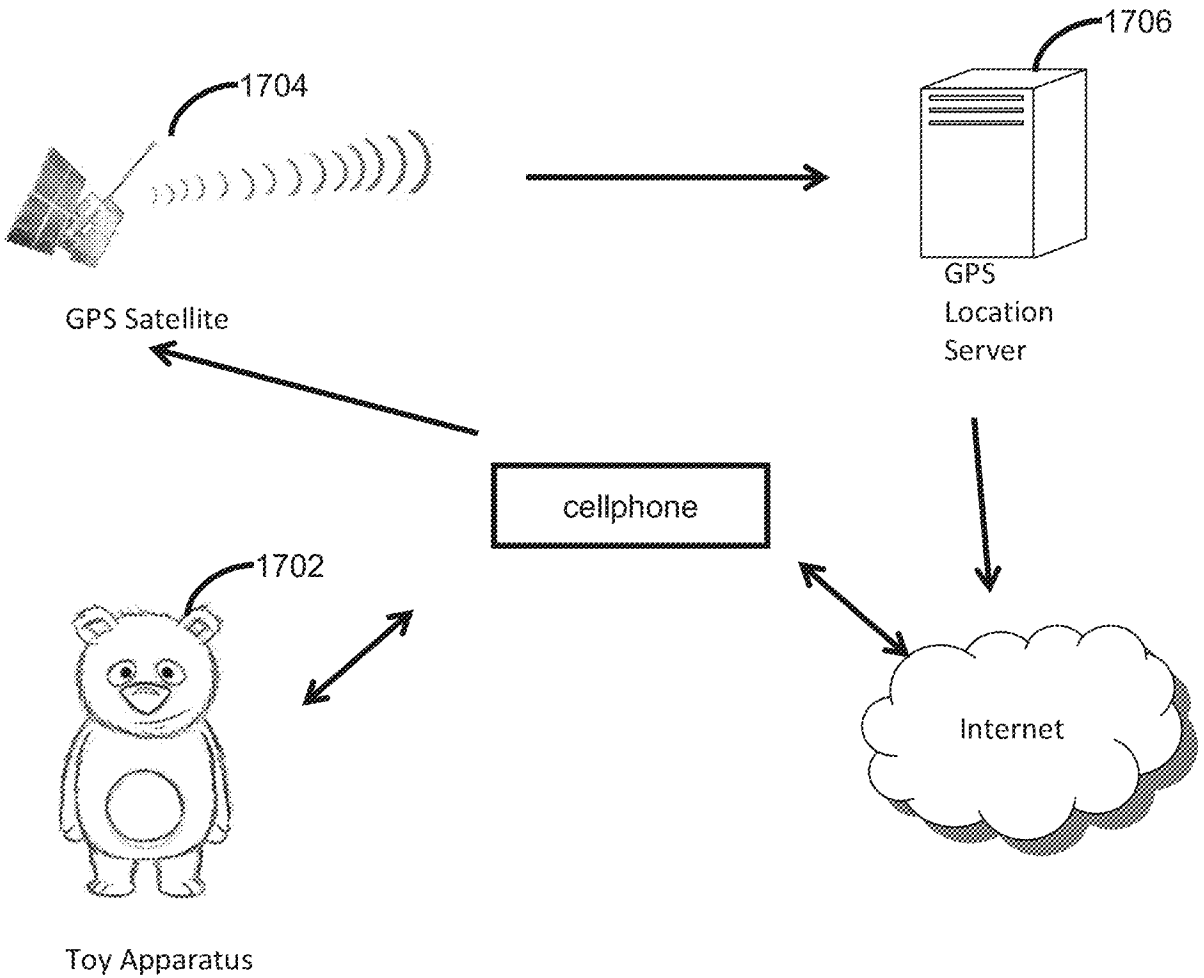
FIG. 19 illustrates a toy apparatus communicating with a cellphone to receive location based services, in accordance with another embodiment of the present invention.

FIG. 19 illustrates yet another embodiment of the present invention, wherein the location of a cellular phone communicating with the toy apparatus may be used to provide location based services to the toy apparatus or may be used to determine a location for the toy. There is shown a toy apparatus 1702 communicating with a cellphone to receive location based services. For example, a coupon code may be sent to the toy apparatus 1702 via a mobile phone, based on the location of the mobile phone.

In yet another embodiment of the present invention, the location of a toy apparatus may be tracked via an IP address of the toy apparatus, when the toy apparatus may be connected to the Internet, or based on a Wi-Fi station location. Based on the location out of the toy apparatus, which was determined from the IP address, relevant location based services may be provided to the toy apparatus.

In yet another embodiment of the present invention, the toy apparatus may include a cellular chip. The cellular chip may be one of a GPRS chip, an EDGE (enhanced data rates for GSM evolution) chip, a CDMA (code division multiple access) chip and a GSM (global system for Mobile Communications) chip. The location may be tracked by the cellular provider based on the location the toy apparatus via the cellular tower triangulation method. Based on the location of the toy apparatus, location based services may be provided to the toy apparatus.

It is expected that during the life of a patent maturing from this application many relevant interactive toys and interactive devices will be developed and the scope of the term "interactive" is intended to include all such new technologies a priori.

As used herein the term "about" refers to ±10%.

The terms "comprises", "comprising", "includes", "including", "having" and their conjugates mean "including but not limited to."

The term "consisting of" means "including and limited to."

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

The invention claimed is:

1. A method for interactive communication between a cellphone and a toy apparatus, said method comprising:

transmitting by the cellphone at least one signal, wherein said at least one signal includes a coupon code and is selected from email, MMS, SMS, and a ringtone;

receiving by the toy apparatus the at least one signal;

analyzing by the toy apparatus the at least one signal;

determining by the toy apparatus at least one response to the at least one signal, wherein the at least one response includes recording the coupon code;

producing by the toy apparatus the at least one response;

accessing by one of an authorized user and a coupon accessing device the coupon code; and deleting by one of the authorized user and the coupon accessing device the coupon code from the toy apparatus.

2. A method according to claim 1, wherein said toy is programmed by said at least one signal.

3. A method according to claim 2, further performed for acquiring additional or alternative programming by the toy apparatus, wherein said at least one signal is an acoustic signal, and wherein the response is external if the signal indicates an activity and the response is programming of the toy, if the signal indicates programming

4. A method according to claim 1, wherein at least one of the at least one signal is an acoustic signal.

5. A method according to claim 1, wherein the at least one response includes generating a signal, transmitting the generated signal to a cellphone, and forwarding the signal by the cellphone.

6. A method according to claim 1, wherein said interactive communication includes acquiring Internet site data, the at least one signal including Internet site data;

wherein said method further comprises, before said transmitting at least one signal: coupling the toy apparatus to an electronic device; and accessing the Internet via the electronic device;

wherein said producing includes transmitting a signal by the toy apparatus to a user responsive to the data.

7. A method for interactive communication with a toy apparatus, the method comprising:

receiving by the toy apparatus at least one first signal including an embedded code;

analyzing by the toy apparatus the code;

determining by the toy apparatus at least one response to the code, said at least one response selected from transmitting the code to another toy apparatus, decoding data from the code and transmitting the decoded data to a person, activating a coupon, transmitting the code to a remote location, processing the code to obtain a coupon, initiating a game, acquiring additional programming, acquiring a service; and producing by the toy apparatus at least one response.

8. A method according to claim 7, wherein said at least one first signal is received from a cellphone.

9. A method according to claim 7, wherein the interactive communication includes coupon redemption, wherein the at least one first signal includes a coupon code, and wherein said producing at least one response includes recording by the toy apparatus the coupon code;

said method further comprising:

assessing by one of an authorized user and a coupon accessing device the coupon code; and deleting by one of the authorized user and the coupon accessing device the coupon code from the toy apparatus.

10. A method according to claim 7, wherein the at least first signal is received from a communication device and wherein the communication device is one of a cellphone, an Internet server, a computer, a laptop, a PDA, a tablet PC, a landline phone, an electronic greeting card, a controller, a toy apparatus and a music player.

11. A method according to claim 7, wherein the at least one first signal contains data.

12. A method according to claim 11, wherein the data is based on the location of the toy apparatus.

13. A method according to claim 11, wherein the data is a coupon code and wherein the coupon code may be redeemed through a plurality of redemption means.

14. A method according to claim 11, wherein the data is a coupon code and wherein the coupon code is one of a one-time use coupon code and a multiple-time use coupon code.

15. A method according to claim 7, wherein the first signal is received from an electronic greeting card and wherein the electronic greeting card is one of an audio greeting card, a video greeting card and a multimedia greeting card.

16. A method according to claim 7, wherein the at least one response is at least one of an audible response, a transmission of information, storage of information, a mechanical response, an activity, and a behavior.

17. A method according to claim 7, wherein the at least one response is at least one of transmitting a message, playing a ringtone, actuating an electronic greeting card and playing music.

18. A method according to claim 7, wherein the at least one response is re-programming of the toy apparatus.

19. A method according to claim 7, wherein the at least one first signal is pre-programmed into the toy apparatus to be received at a predetermined time.

* * * * *